US008961380B2

(12) United States Patent
Langen

(10) Patent No.: US 8,961,380 B2
(45) **Date of Patent: *Feb. 24, 2015**

(54) METHOD AND SYSTEM FOR FORMING A CARTON FROM A CARTON BLANK

(76) Inventor: H. J. Paul Langen, Brampton (CA)

( * ) Notice: Subject to any disclaimer, the term of this patent is extended or adjusted under 35 U.S.C. 154(b) by 84 days.

This patent is subject to a terminal disclaimer.

(21) Appl. No.: 12/998,047

(22) PCT Filed: Sep. 11, 2009

(86) PCT No.: PCT/CA2009/001249

§ 371 (c)(1),
(2), (4) Date: Mar. 11, 2011

(87) PCT Pub. No.: WO2010/028485

PCT Pub. Date: Mar. 18, 2010

(65) Prior Publication Data

US 2011/0166007 A1 Jul. 7, 2011

Related U.S. Application Data

(60) Provisional application No. 61/136,542, filed on Sep. 12, 2008.

(51) Int. Cl.
*B31B 5/00* (2006.01)
*B31B 1/00* (2006.01)
(Continued)

(52) U.S. Cl.
CPC ... *B31B 1/46* (2013.01); *B31B 1/06* (2013.01); *B31B 1/44* (2013.01); *B31B 3/00* (2013.01);
(Continued)

(58) Field of Classification Search
CPC ..... B31B 1/06; B31B 1/44; B31B 1/46; B31B 3/28; B31B 3/46; B31B 2201/0264; B31B 2201/2654; B31B 2201/2666; B65D 5/20; B65D 5/36
USPC ..... 493/126, 127, 163, 175, 176, 181, 183
See application file for complete search history.

(56) References Cited

U.S. PATENT DOCUMENTS 1,643,564 A 9/1927 Seiler
2,997,830 A 8/1961 Nelson
(Continued)

FOREIGN PATENT DOCUMENTS

CA 1242422 9/1988
FR 2775658 A1 9/1999
JP S54143385 A 11/1979

OTHER PUBLICATIONS

International Search Report for PCT International Application No. PCT/CA2009/001249, filed Sep. 11, 2009.
(Continued)

*Primary Examiner* — Hemant M Desai
(74) *Attorney, Agent, or Firm* — Smart & Biggar

(57) ABSTRACT

Systems and methods are disclosed for forming a carton. The system may comprise a magazine for storing a plurality of carton blanks in a generally flat configuration. The system also has a mandrel and a panel rotation apparatus. The mandrel has a first surface oriented at a first orientation and a second surface oriented at a second orientation that may be generally orthogonal to the first orientation. The panel rotation apparatus is operable to engage a second panel of the carton blank and rotate the second panel to proximate to, and generally in the same orientation as, the second surface of the mandrel such that the second panel is oriented in a second orientation generally orthogonal to the first panel.

31 Claims, 27 Drawing Sheets

(51) Int. Cl.

| | |
|---|---|
| ***B31B 5/36*** | (2006.01) |
| ***B31B 5/74*** | (2006.01) |
| ***B31B 1/46*** | (2006.01) |
| ***B31B 1/06*** | (2006.01) |
| ***B31B 1/44*** | (2006.01) |
| ***B31B 3/00*** | (2006.01) |
| ***B65D 5/20*** | (2006.01) |

(52) U.S. Cl.

CPC ..... *B65D 5/20* (2013.01); *B31B 2201/0264* (2013.01); *B31B 2201/2654* (2013.01); *B31B 2201/2666* (2013.01)

USPC ..... 493/127; 493/163; 493/183

(56) References Cited

U.S. PATENT DOCUMENTS

| | | | | |
|---|---|---|---|---|
| 3,196,761 | A | 7/1965 | Ullman | |
| 3,280,531 | A | 10/1966 | Meyer-Jagenberg | |
| 3,461,642 | A | 8/1969 | Langan at al. | |
| 3,543,469 | A | 12/1970 | Ullman | |
| 3,590,700 | A * | 7/1971 | Paxton et al. | 493/6 |
| 3,611,885 | A * | 10/1971 | Paxton | 493/142 |
| 3,854,651 | A | 12/1974 | Osborne | |
| 3,866,391 | A | 2/1975 | Puskarz et al. | |
| 3,941,037 | A * | 3/1976 | Reichert | 493/167 |
| 3,986,319 | A | 10/1976 | Puskarz et al. | |
| 3,990,210 | A | 11/1976 | McDonough et al. | |
| 4,164,171 | A | 8/1979 | Meyers et al. | |
| 4,932,930 | A * | 6/1990 | Coalier et al. | 493/128 |
| 5,154,041 | A | 10/1992 | Schneider | |
| 5,593,375 | A | 1/1997 | Franci | |
| 5,876,319 | A * | 3/1999 | Holton | 493/84 |
| 7,678,036 | B1 | 3/2010 | Malitas et al. | |
| 7,935,041 | B2 * | 5/2011 | Graham et al. | 493/98 |
| 8,323,165 | B2 * | 12/2012 | Atoui | 493/175 |
| 2002/0033351 | A1 | 3/2002 | Usui et al. | |
| 2007/0037682 | A1 * | 2/2007 | Scholtes et al. | 493/175 |
| 2008/0110967 | A1 | 5/2008 | Walling | |
| 2010/0263333 | A1 * | 10/2010 | Langen | 53/456 |
| 2011/0065559 | A1 * | 3/2011 | Atoui | 493/175 |

OTHER PUBLICATIONS

International Search Report for PCT International Application No. PCT/CA2010/001948, filed Dec. 8, 2010.

Written Opinion for PCT International Application No. PCT/CA2010/001948, filed Dec. 8, 2010.

Extended European Search Report for EP 09812568.5 dated Jan. 17, 2014.

* cited by examiner

METHOD AND SYSTEM FOR FORMING A CARTON FROM A CARTON BLANK

RELATED APPLICATION

This application is a National Stage application under 35 U.S.C. 371 of International Application No. PCT/CA2009/001249, filed on Sep. 11, 2009, which claims priority from U.S. patent application Ser. No. 61/136,542 filed Sep. 12, 2008, the contents of which are hereby incorporated by reference herein in their entirety.

FIELD OF THE INVENTION

The present invention relates generally to methods and systems for forming containers, including cartons.

BACKGROUND OF THE INVENTION

Containers are used to package many different kinds of items. One form of container used in the packaging industry is a carton. Cartons come in many different configurations and are made from a wide variety of materials. However, many cartons are foldable and are formed from a flattened state (commonly called a carton blank). Cartons may be made from an assortment of foldable materials, including cardboard, paperboard, corrugated fibreboard, plastic materials, composite materials, and the like and possibly even combinations thereof.

In many known systems, carton blanks may be serially retrieved from a carton magazine, opened up from a flattened state into an erected state, and placed in a slot on a carton conveyor. The erected carton may then be moved by the carton conveyor to a loading station where the carton may be filled with one or more items.

To permit the cartons to be readily opened up into an erected state from a flattened state, the blanks may be held in the magazine in a partially folded configuration and be partially glued along one side seam. Accordingly, each carton may only require opposite panels to be pulled apart to provide a tubular shape that is suitable for delivery to a carton conveyor. The carton can then be filled from the side while on the carton conveyor and any required additional panel folding and gluing can be carried out to enclose and fully seal the carton with one or more items contained therein.

However, such pre-folded and pre-glued blanks are not well adapted to shipping in bulk due to their asymmetric shape—being three layers thick on the glued seam area and only two layers thick elsewhere. Unstable stacking characteristic of such blanks requires the use of secondary containers and also reduces the number of blanks that can be shipped per unit volume. Both of these factors result in increased shipping costs which may be in the order of $8 to $10 per 1000 blanks compared to blanks that can be shipped in a completely flat arrangement. Additionally, some types of items do not lend themselves particularly well to being side-loaded into a carton; rather such products are more readily loaded into the top of an open-top carton. It can also be advantageous to be able to load some products through a relatively large opening, compared to smaller opening in a side-loaded carton.

Some other carton forming systems are adapted to forming a carton that can be top-loaded with a product. In such known systems, a carton magazine may hold a number of blanks that are completely unfolded and unglued and which lie completely flat in a stack in the magazine. However, currently quite complicated systems are required in order to fold and configure the blank so that it is suitable to receive one or more items. One known type of such system involves the use of a specially configured shoe device and associated plunger. A flattened blank can be retrieved from a magazine and then be placed above an opening in the shoe and the plunger can push the blank into a cavity formed in the shoe. The configuration of the shoe is such that various panels that make up the blank will be folded in relation to each other as the blank is pushed into the cavity by the plunger. The result is that a general carton shape is produced that may be further folded and glued to place the carton into a form suitable for delivery to a carton conveyor. Alternatively, the carton blank may be pre-formed with interlocking panels that once the blank is folded within the shoe device, side panels will interlock with each other to form a carton that maintains its form without the use of glue (e.g. "click-lock" carton blanks). Such cartons are formed with open tops. Once delivered to a carton conveyor the carton may be moved to a station where an item can be placed in the carton. Thereafter any required additional panel folding and gluing can be carried out to enclose and fully seal the carton.

However there are also significant drawbacks to these carton-forming systems. For example, a different shoe (and possibly plunger as well) may be required for each different sized/shaped carton blank. Additionally extraction of the formed carton from the shoe may require additional relatively complex machinery. This method of carton forming is also relatively slow and can only form cartons of limited depth.

In the formation of cartons from corrugated fibreboard material, it is also typically necessary as part of the forming process to fold over various parts of a blank made from a corrugated fibreboard material. However, current folding processes and machines are relatively complex.

Accordingly, an improved forming method and system is desirable which can readily form a container such as a carton from a generally flat blank. Furthermore, an improved forming method and system is desirable which can form cartons capable of being top loaded, with deeper trays than conventional "click-lock" formers and at higher rates of speed. Finally, an improved method and system is desirable which can be rapidly modified to accommodate cartons of different sizes and which produces cartons with increased structural stability and leak resistance due to the lack of a seam on the bottom portion of the carton.

SUMMARY OF THE INVENTION

According to one aspect of the invention there is provided a system for forming a carton from a carton blank oriented in a first generally flat orientation. The system comprises a mandrel having a first surface and a second surface oriented generally orthogonal to the first surface, wherein said carton blank has a first portion that can be positioned proximate the first surface of the mandrel apparatus. The system also comprises a first rotating apparatus operable to engage the second portion of the carton blank and rotate the second portion from the first orientation such that the second portion is oriented in a second orientation that is generally orthogonal to the first portion of the carton blank and the second portion of the carton blank being positioned proximate the second surface of the mandrel.

According to another aspect of the invention there is provided a system for forming a carton comprising:

(a) a magazine for storing a plurality of carton blanks in a generally flat configuration;

(b) a mandrel having a first surface and a second surface oriented generally orthogonal to the first surface;

(c) a transfer mechanism for transferring the carton blanks in series from the magazine to the mandrel (d) a panel holding mechanism for holding a first panel of the carton blank in a first orientation and in a position proximate the first surface of the mandrel;

(e) a panel rotation apparatus operable to engage a second panel of the carton blank and rotate the second panel to proximate to, and generally in the same orientation as, the second surface of the mandrel such that the second panel is oriented in a second orientation generally orthogonal to the first panel.

According to another aspect of the invention there is provided a system for forming a carton from a generally flat carton blank, said system comprising:

(a) a mandrel having a first surface oriented generally at a first orientation and a second surface oriented at a second orientation that is at an angle to the first orientation, wherein the carton blank has a first portion that can be positioned proximate the first surface of the mandrel;

(b) a first rotating apparatus operable to engage the second portion of the carton blank and rotate the second portion of the blank from the first orientation while the first portion is maintained in a position proximate the first surface of the mandrel such that the second portion is oriented in the second orientation that is generally at the angle to the first portion of the carton blank and the second portion of the carton blank being positioned proximate the second surface of the mandrel.

According to another aspect of the invention there is provided a system for forming a carton comprising:

(a) a magazine for storing a plurality of carton blanks in a generally flat configuration;

(b) a mandrel having a first surface oriented at a first orientation and a second surface oriented at a second orientation that is generally orthogonal to the first orientation;

(c) a panel rotation apparatus operable to engage a second panel of the carton blank and rotate the second panel to proximate to, and generally in the same orientation as, the second surface of the mandrel such that the second panel is oriented in a second orientation generally orthogonal to the first panel.

According to another aspect of the invention there is provided a method for forming a carton from a carton blank comprising:

(a) orienting the carton blank in a generally flat first orientation;

(b) rotating a first portion of the blank from the first orientation to a second orientation that is generally orthogonal to the second portion.

According to another aspect of the invention there is provided a method of forming a carton from a carton blank comprising:

(a) providing a carton blank in a first generally flat orientation, the carton blank having first and second portions, the first portion of blank being generally adjacent and parallel to a first portion of a mandrel;

(b) rotating the second portion of the carton blank about the mandrel so the second portion is positioned at a second orientation that is generally orthogonal to the first portion.

According to another aspect of the invention there is provided a method for forming a carton from a carton blank comprising:

(a) orienting a carton blank having first, second and third portions all oriented in a first planar orientation;

(b) rotating first and second portions of the blank from the first orientation to a second orientation while maintaining the third portion in the first orientation;

(c) further rotating the third portion of the carton blank relative to the first and second portions to a third orientation.

According to another aspect of the invention there is provided a method for forming a carton comprising:

(a) Retrieving a carton blank from a magazine storing a plurality of carton blanks in a generally flat configuration;

(b) transferring the retrieved carton blank from the magazine to a mandrel comprising a first surface and a second surface oriented generally orthogonal to the first surface;

(c) positioning a first panel of the carton blank in a first orientation and in a position proximate to the first surface of the mandrel;

(d) engaging a second panel of the carton blank and rotating the second panel to proximate to, and generally in the same orientation as, the second surface of the mandrel such that the second panel is oriented in a second orientation generally orthogonal to the first panel.

According to another aspect of the invention there is provided a method for forming a carton from a carton blank comprising:

(a) orienting a carton blank having a plurality of portions all oriented in a first planar orientation;

(b) rotating a first portion of said plurality of portions from said first orientation to a second orientation while maintaining a plurality of remaining portions of said blank in said first orientation;

(c) orienting the remaining portions of said carton blank relative to said first portion to form a carton adapted for receiving an item.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
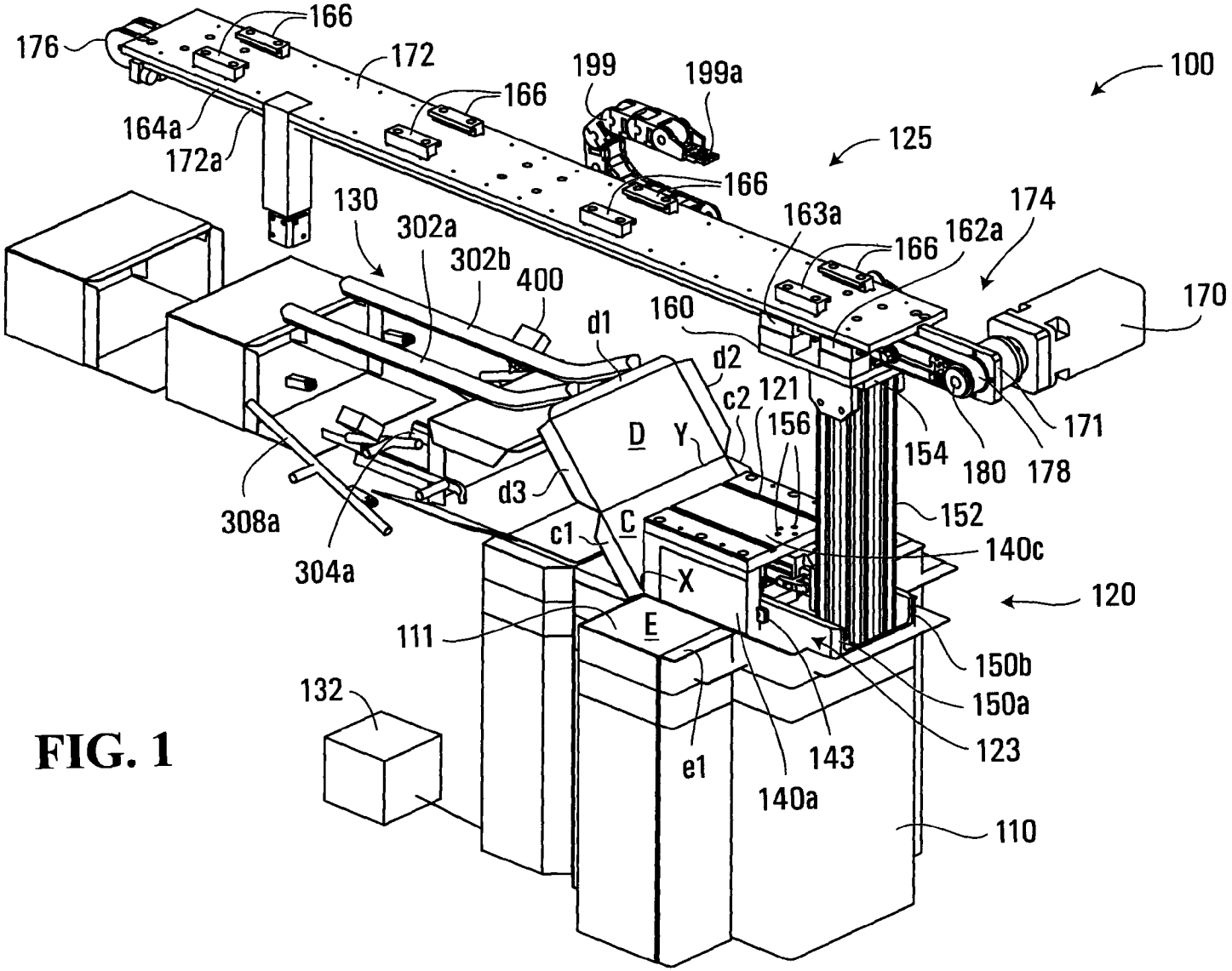
FIG. 1 is a top, left front perspective view of a carton forming system in accordance with a first example embodiment of the present invention, and illustrating the movement of a blank longitudinally through the system.

With reference to FIGS. 1-5, a carton forming system 100 may include a magazine 110 adapted to hold a plurality of carton blanks 111 in a substantially flat orientation. System 100 may also include a mandrel apparatus 120, a panel rotating apparatus 124, and a panel folding and guide apparatus 130. The operation of carton forming system 100 may be controlled by a programmable logic controller ("PLC") 132 (only shown schematically in FIG. 1). PLC 132 may for example be a model from the Micrologix family made by Allen-Bradley.

Figure 1A:
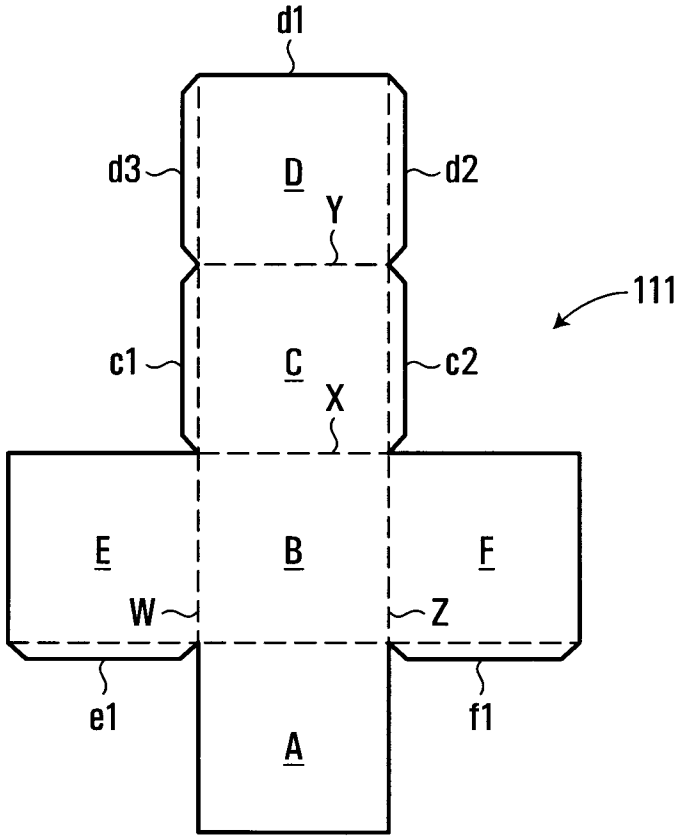
FIG. 1A is a plan view of an example carton blank that may be processed by a system as shown in FIG. 1.
Figure 2:
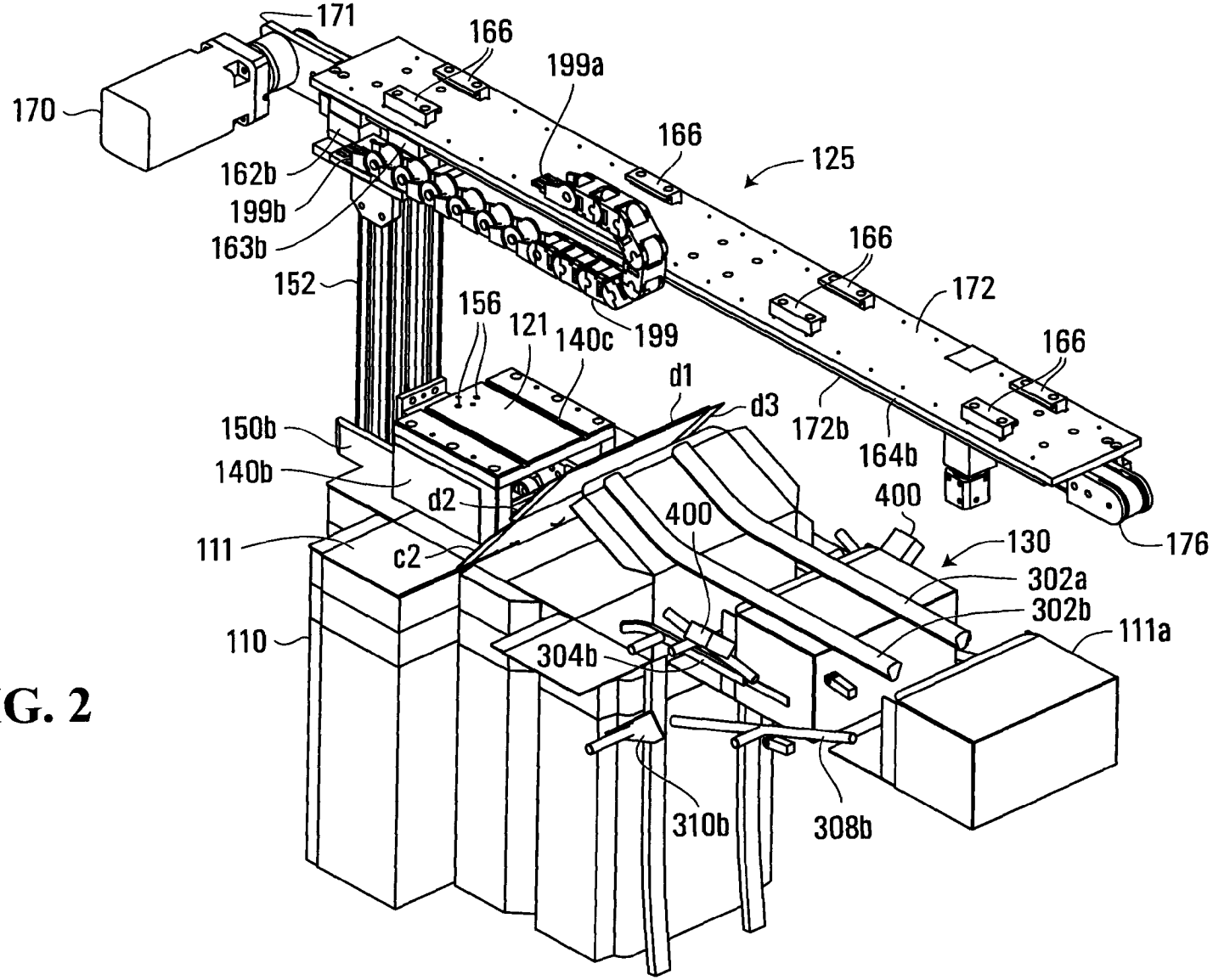
FIG. 2 is a top, right rear side perspective view of the system of FIG. 1.
Figure 3:
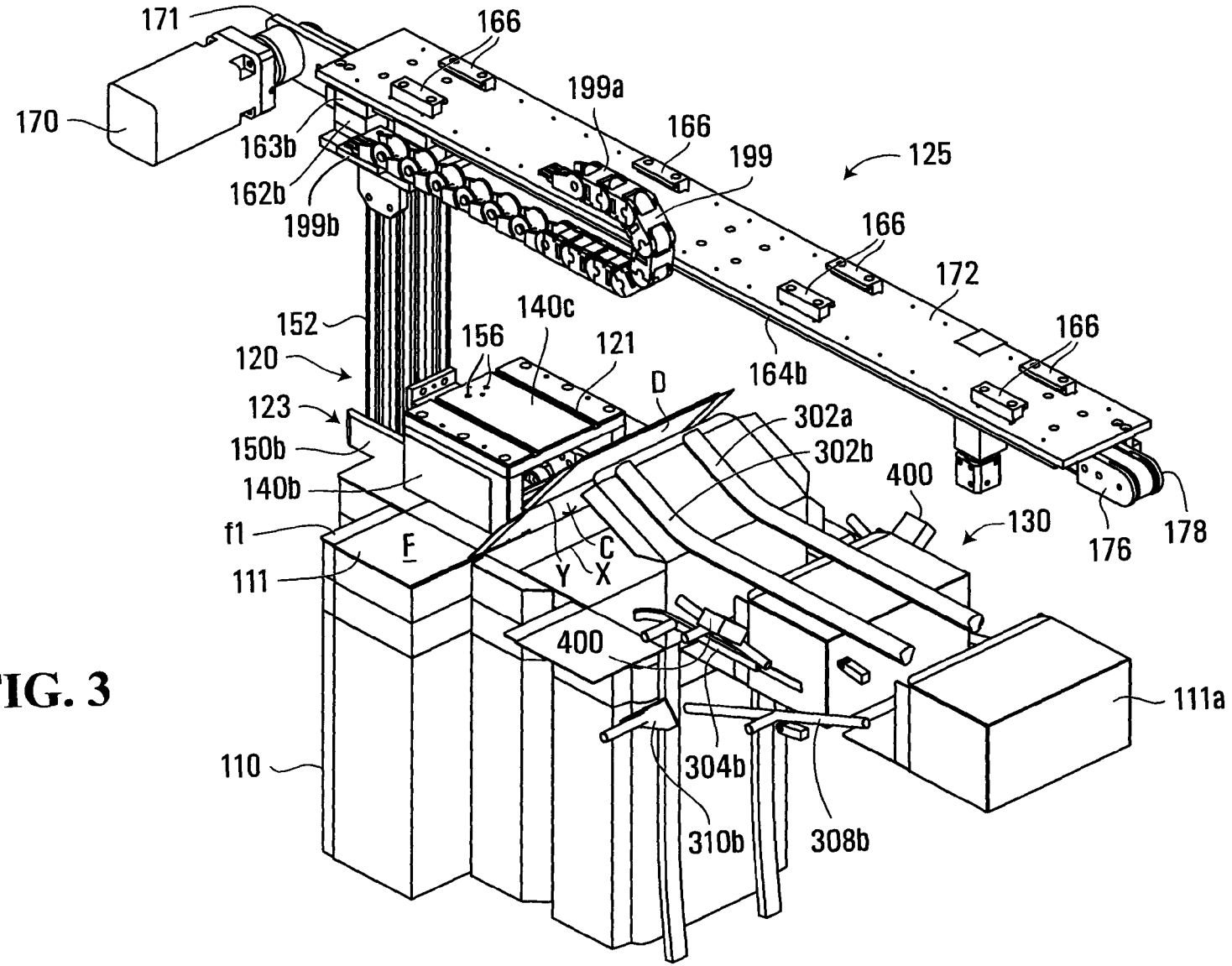
FIG. 3 is a top, right rear perspective view of the system of FIG. 1.
Figure 4:
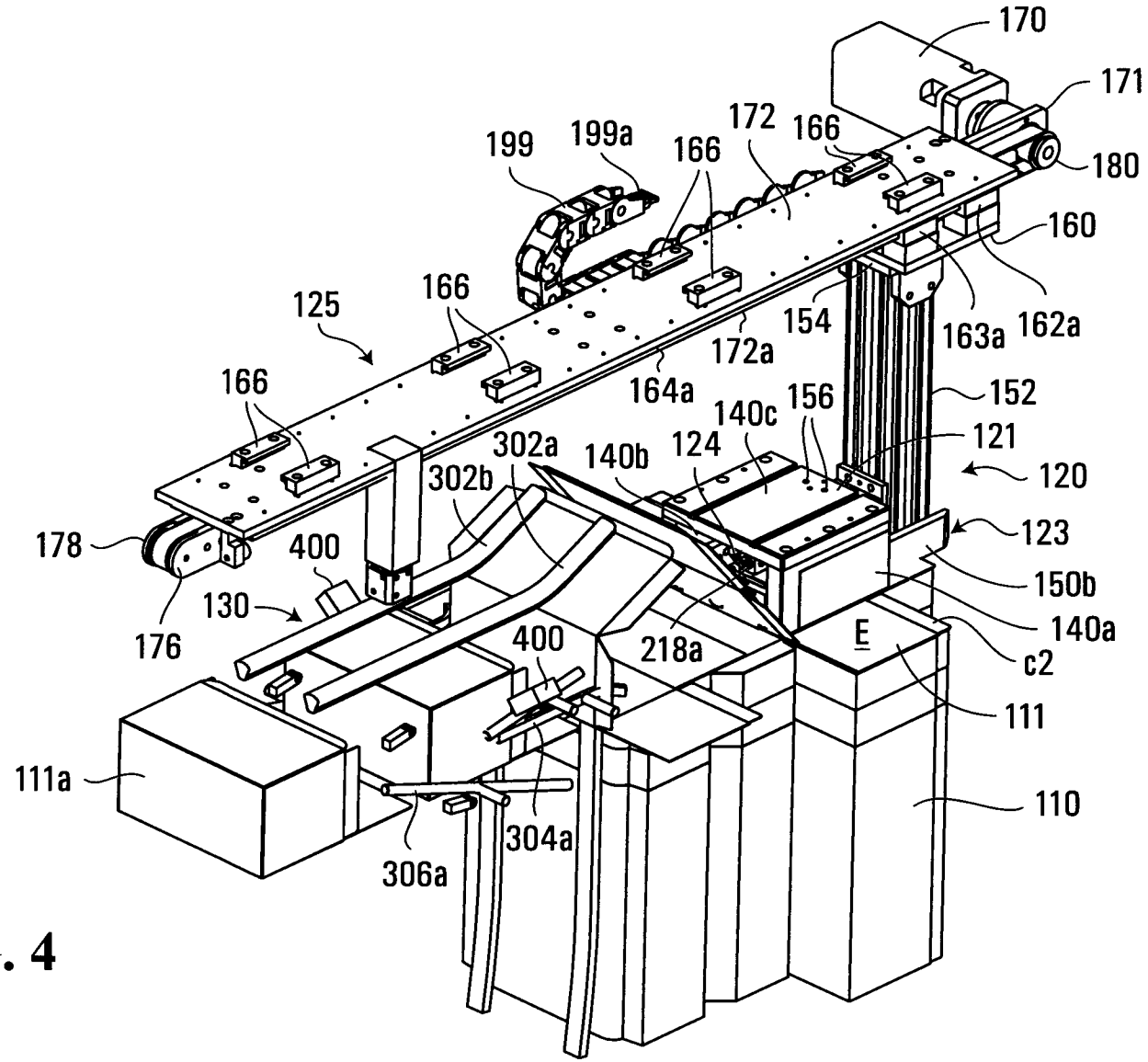
FIG. 4 is a top, left rear perspective view of the system of FIG. 1.
Figure 5:
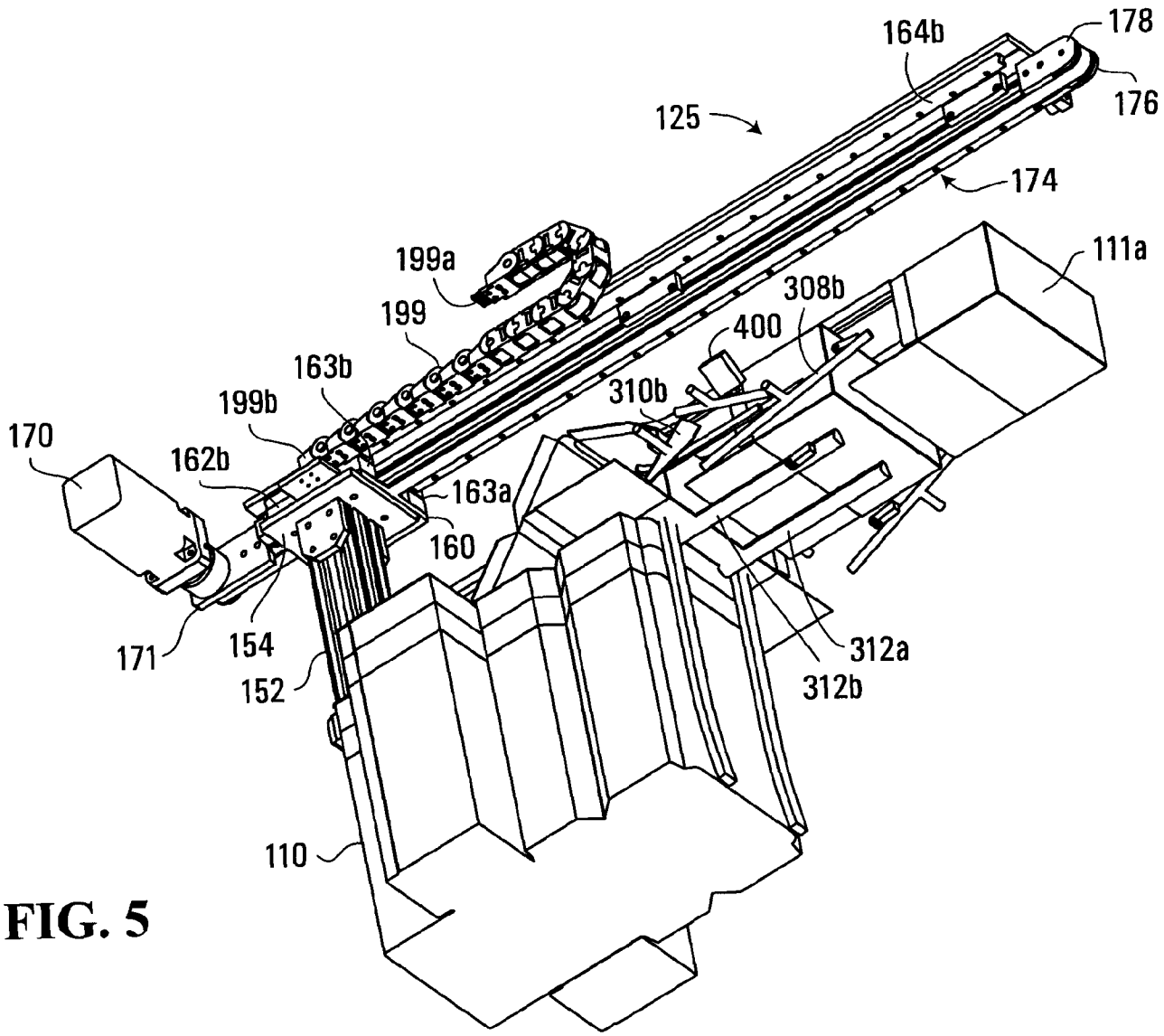
FIG. 5 is a bottom, right rear perspective view of the system of FIG. 1.
Figure 6:
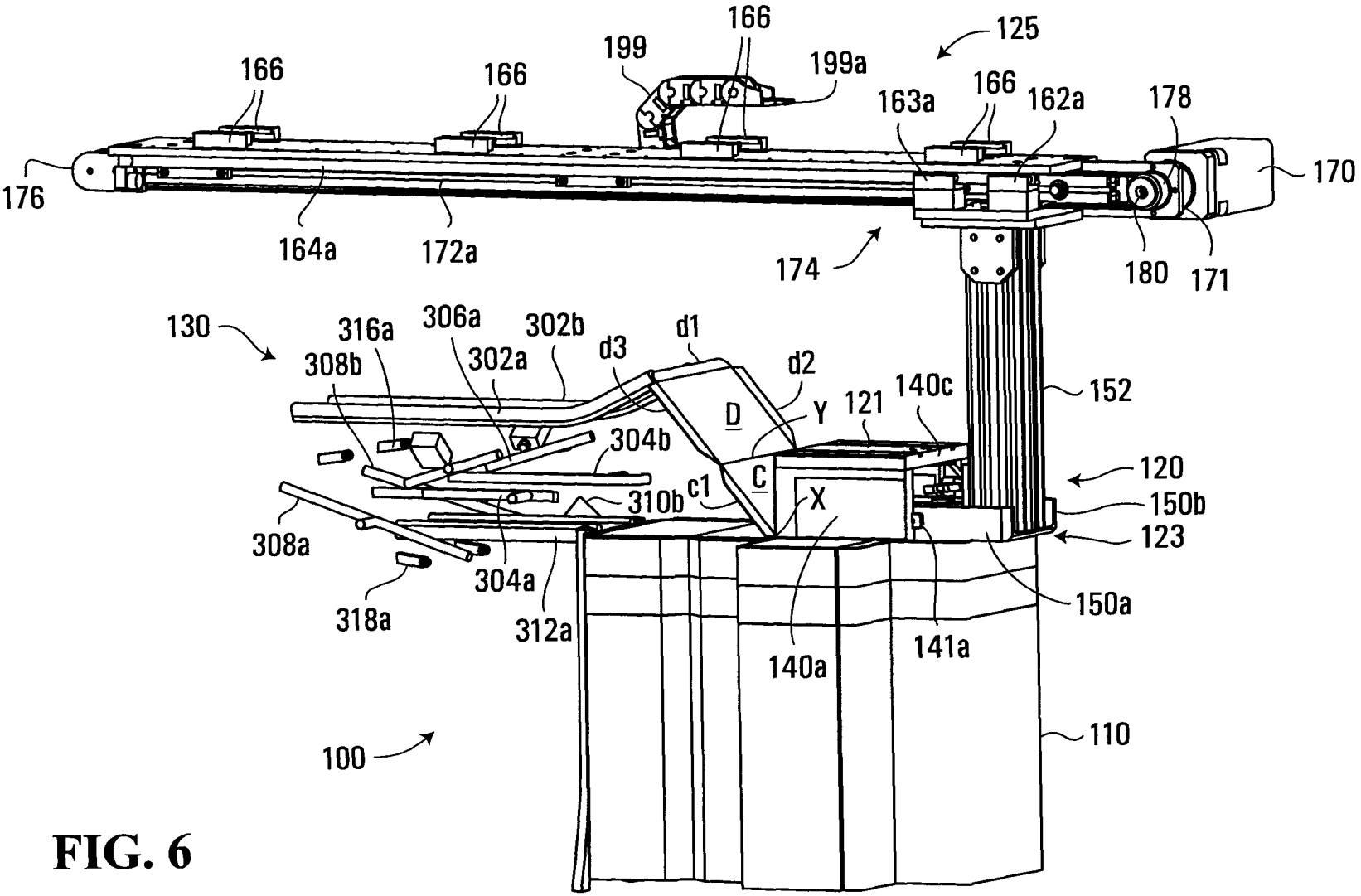
FIGS. 6 to 18 are various additional perspective views of the system of FIG. 1, illustrating the sequential forming of a carton from a blank using the system of FIGS. 1 to 5.

With reference to FIG. 1A, each carton blank 111 may have six side panels A to F, and a plurality of sealing flaps such as flaps c1, c2; d1, d2, d3; e1 and f1. However, in other embodiments, containers having other side panel configurations can be formed. The panels and flaps are connected to adjacent flaps/panels by predetermined fold/crease lines (shown in broken lines). These fold/crease lines may be formed by a weakened area of material and/or the formation of a crease with a crease forming apparatus. The effect of the fold line is such that when one panel such as for example panel C is bent relative to an adjacent panel such as D or B, the panels will tend to rotate relative to each other along the fold lines (Y, X respectively). Likewise, panels E and B may tend to fold/rotate relative to each other about fold line W and panels F and B may tend to fold/rotate relative to each other about fold line Z. Flaps d1, d2, d3, c1, c2, e1 and f1 may also fold about fold lines that connect them to their respective panels.

As will be described hereinafter, the side panels may be folded to form the desired carton configuration for a top loading carton that can be delivered to a carton loading conveyor. The sealing flaps provide material that can, in conjunction with a connection mechanism (such as for example with application of an adhesive or a mechanical connection such as is provided in so-called "click-lock" carton blanks) interconnect panel/flap surfaces, to join or otherwise interconnect, panels to adjacent panels, to hold the carton in its desired configuration.

Carton blanks 111 may be made of any suitable material(s) configured and adapted to permit the required folding/bending/displacement of the material to reach the desired configuration. Examples of suitable materials are cardboard or creased corrugated fiberboard. It should be noted that the blank may be formed of a material which itself is rigid or semi-rigid, and not per se easily foldable but which is divided into separate panels/flaps separated by creases or hinge type mechanisms so that the carton can be formed.

Magazine 110 may be configured to hold a plurality of carton blanks 111 in a vertically stacked, flat configuration, and be operable to move the stack of carton blanks 111 sequentially upwards under the control of PLC 132, so that single carton blanks 111 may be retrieved from the stack for processing by a panel retrieval and rotating apparatus generally designated as 124 that forms part of mandrel apparatus 120. Various specific constructions of a suitable magazine that might be employed in system 100 would be evident to a person skilled in the art. The magazine may comprise basically a large number of carton blanks held in a vertical stack by aluminium rails (the rails are not shown in the drawings). In this configuration where blanks are retrieved from the top of a stack, the stack of blanks in the magazine is moved upwards from the bottom by a PLC controlled motor (not shown in drawings). The purpose of moving the stack of blanks upwards as cartons are formed is so that the top carton is always close against the bottom of the mandrel. The front panels of the top blank are then rotated around the mandrel by the panel rotation apparatus 124. As cartons are taken and formed, the PLC may move the entire stack up sequentially so that the top carton is always pressed close to the mandrel 121.

Figure 10:
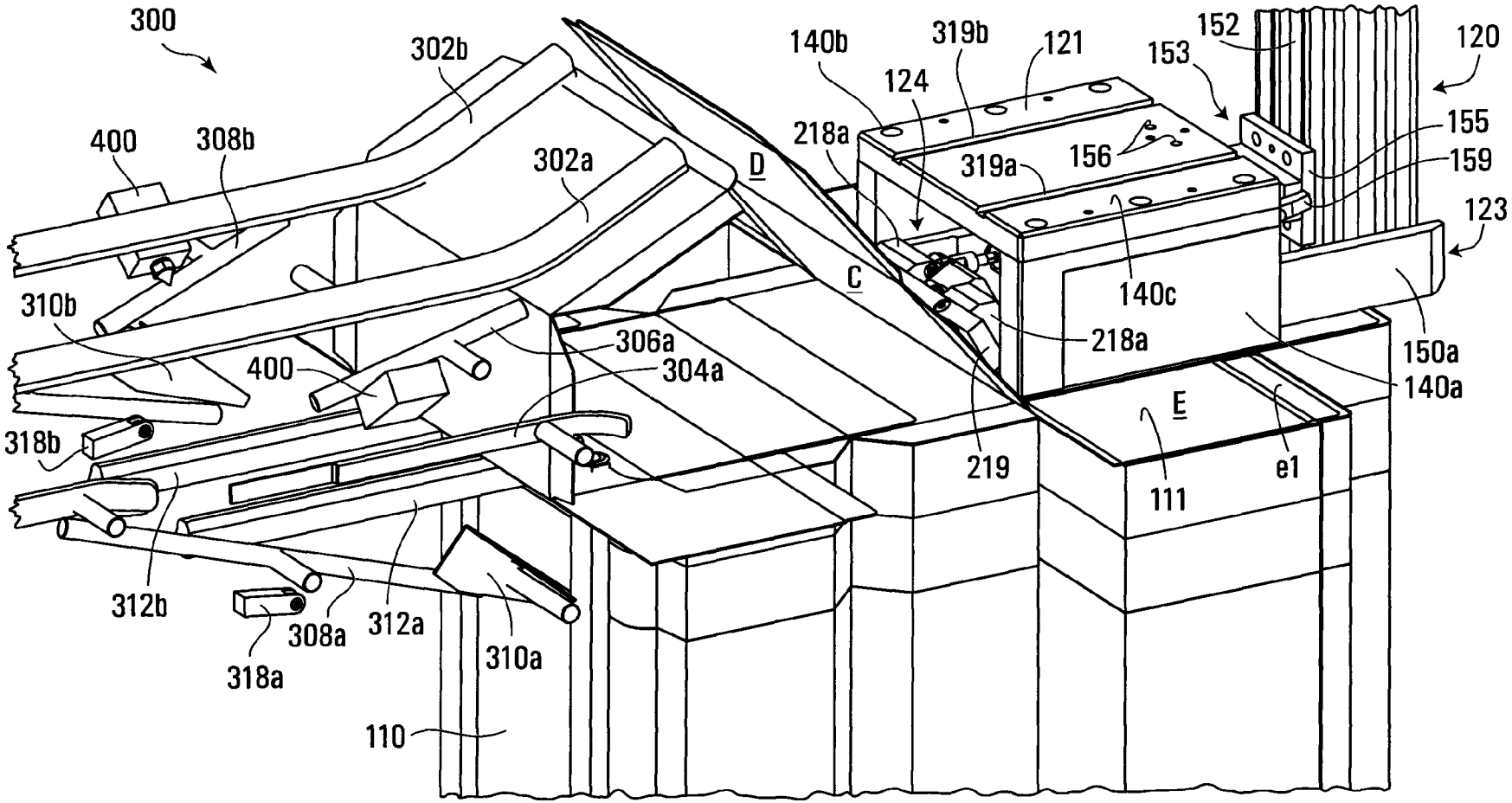
Figure 11:
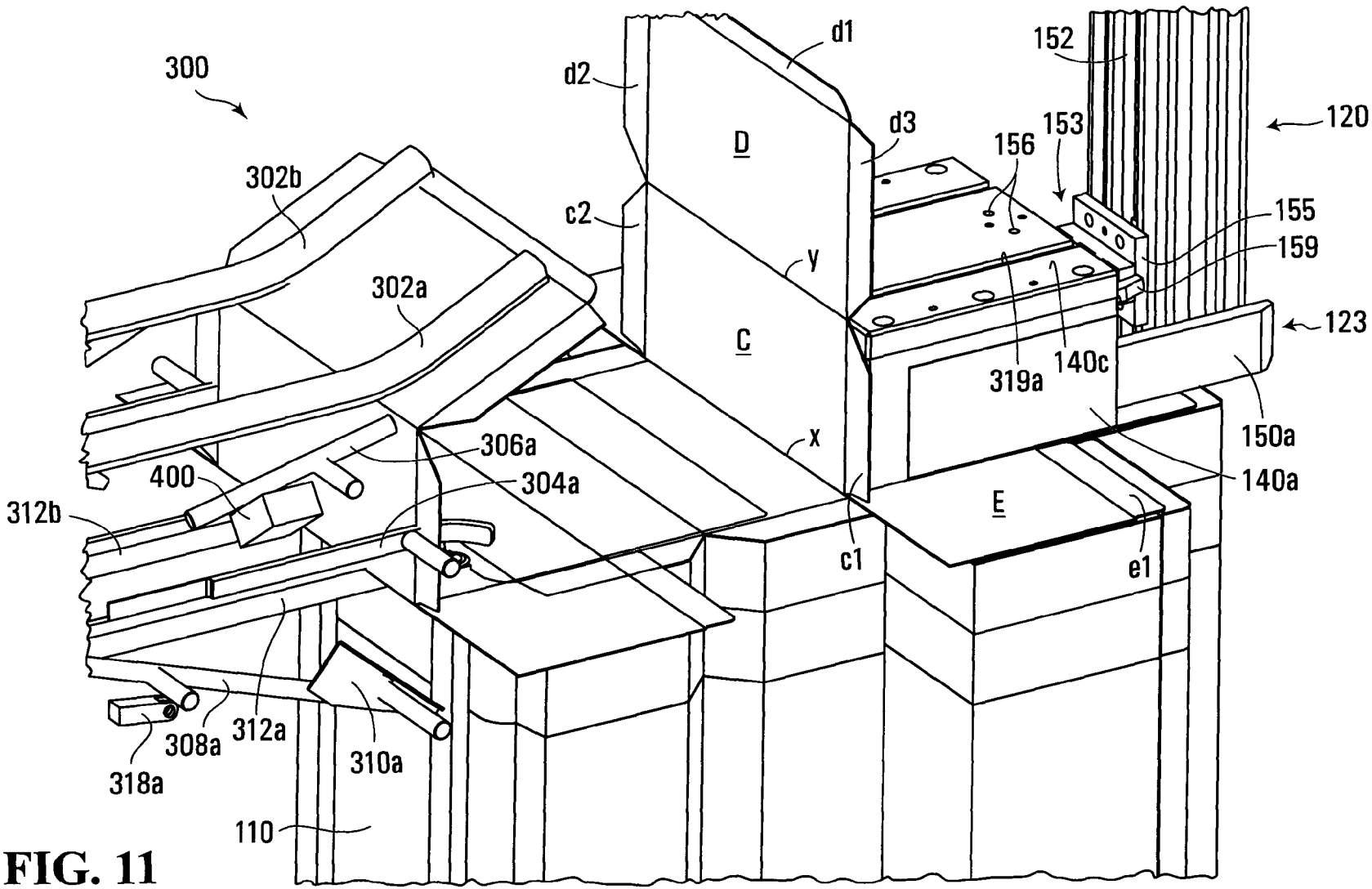
Figure 12:
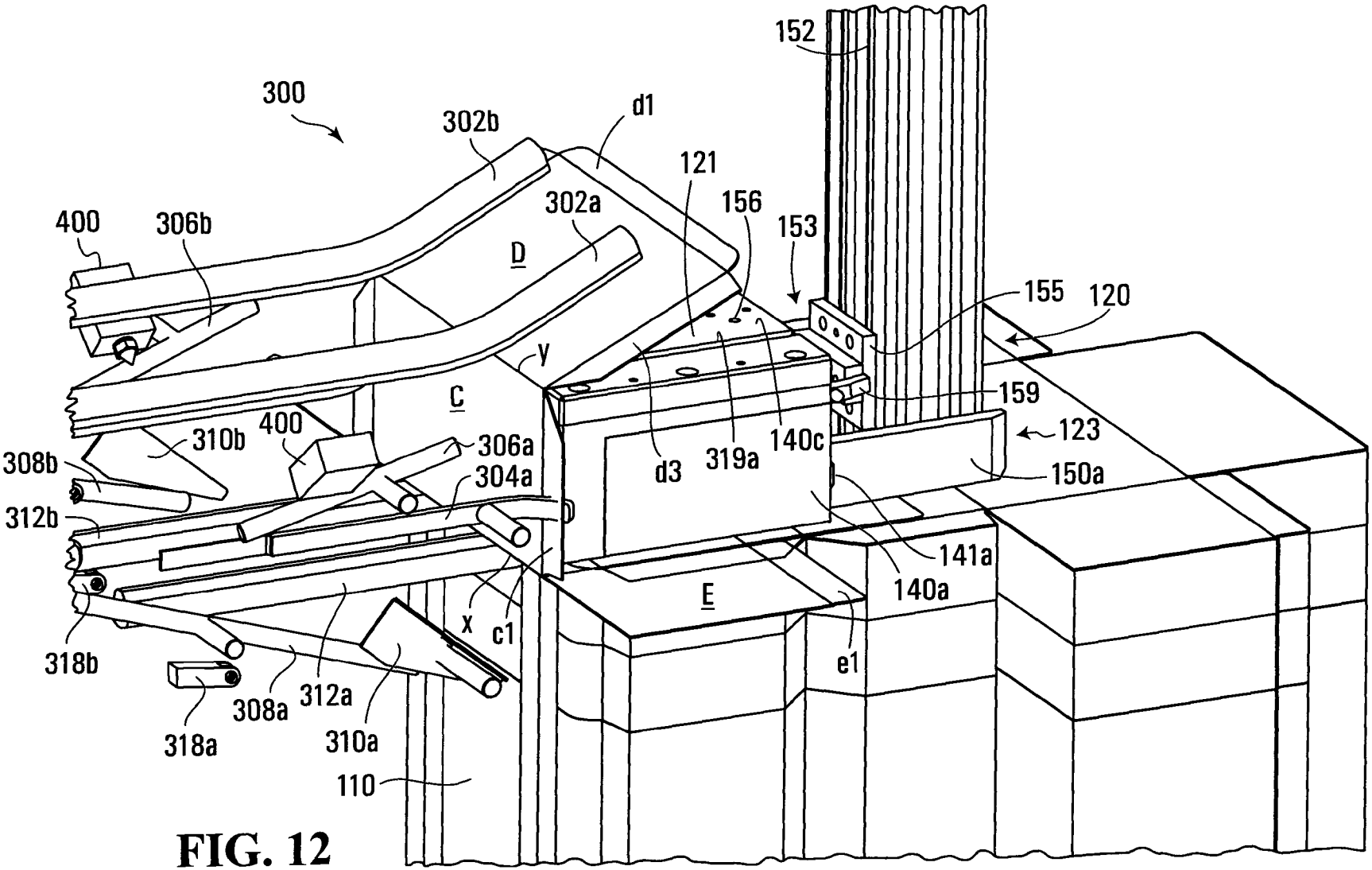

The mandrel apparatus 120 may have several additional components including a mandrel 121, a mandrel support frame 123 and a mandrel movement and support apparatus generally designated 125. With particular reference to FIGS. 1, 10 and 11, mandrel 121 comprises a pair of opposed, spaced, vertically and longitudinally oriented side plates 140*a*, 140*b* interconnected to and joined by a horizontally oriented top plate 140*c*. A mandrel 121 may be generally configured in a variety of different sizes and shapes, each selected for the particular carton blank 111 that is being formed into a carton. The dimensions of the outer surfaces of mandrel 121 may be selected so that the specific carton blank that it is desired to fold has during the forming process, fold/crease lines that are located substantially at or along the opposite side edges and the upper and lower front edges of mandrel 121. Such a selection may improve the performance of system 100 in creating a formed carton that is ready for loading with items. System 100 may be configured to permit for the easy interchange of mandrels 121 so that the system can be readily adapted to forming differently sized/shaped cartons from differently configured blanks.

Figure 8:
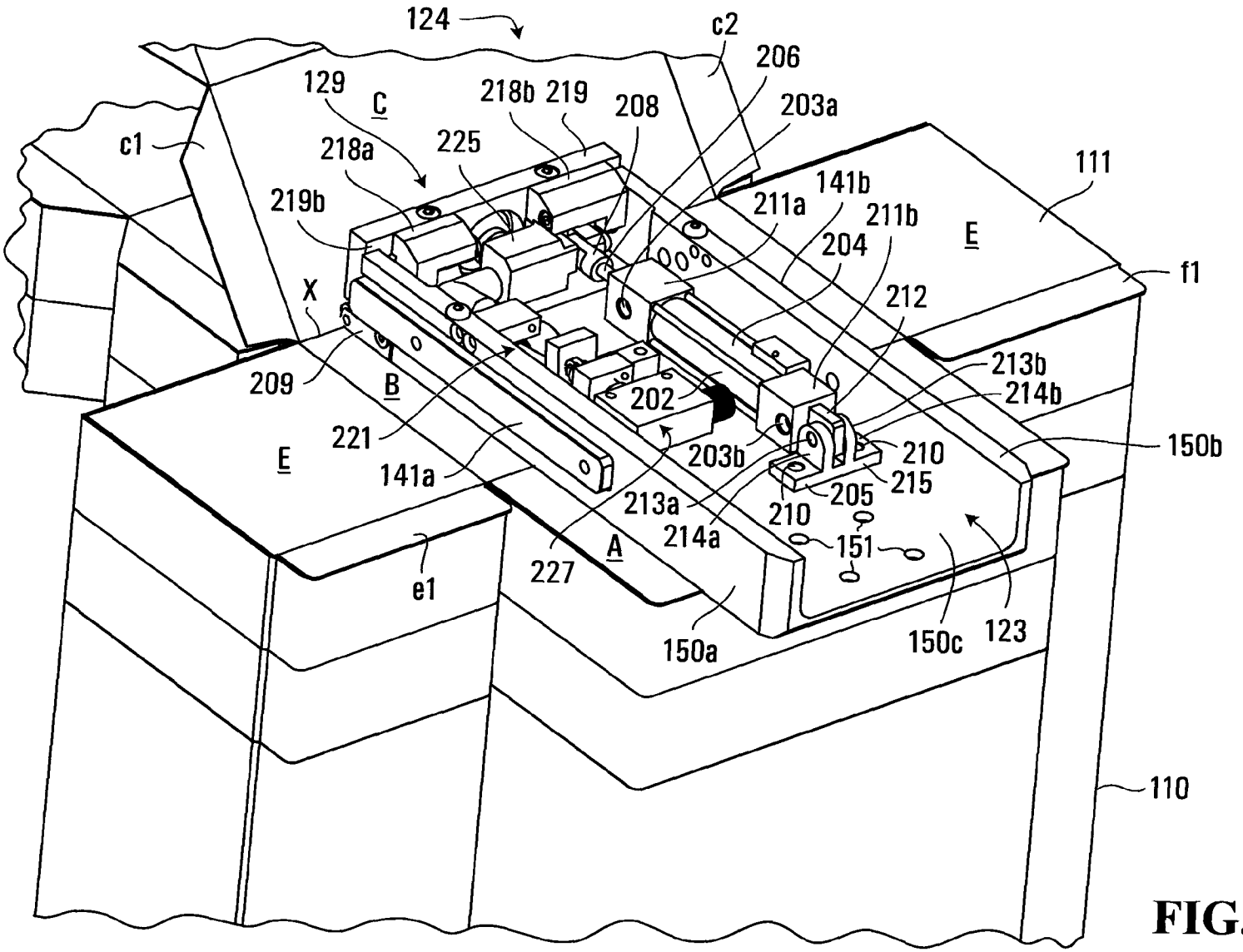
Figure 9:
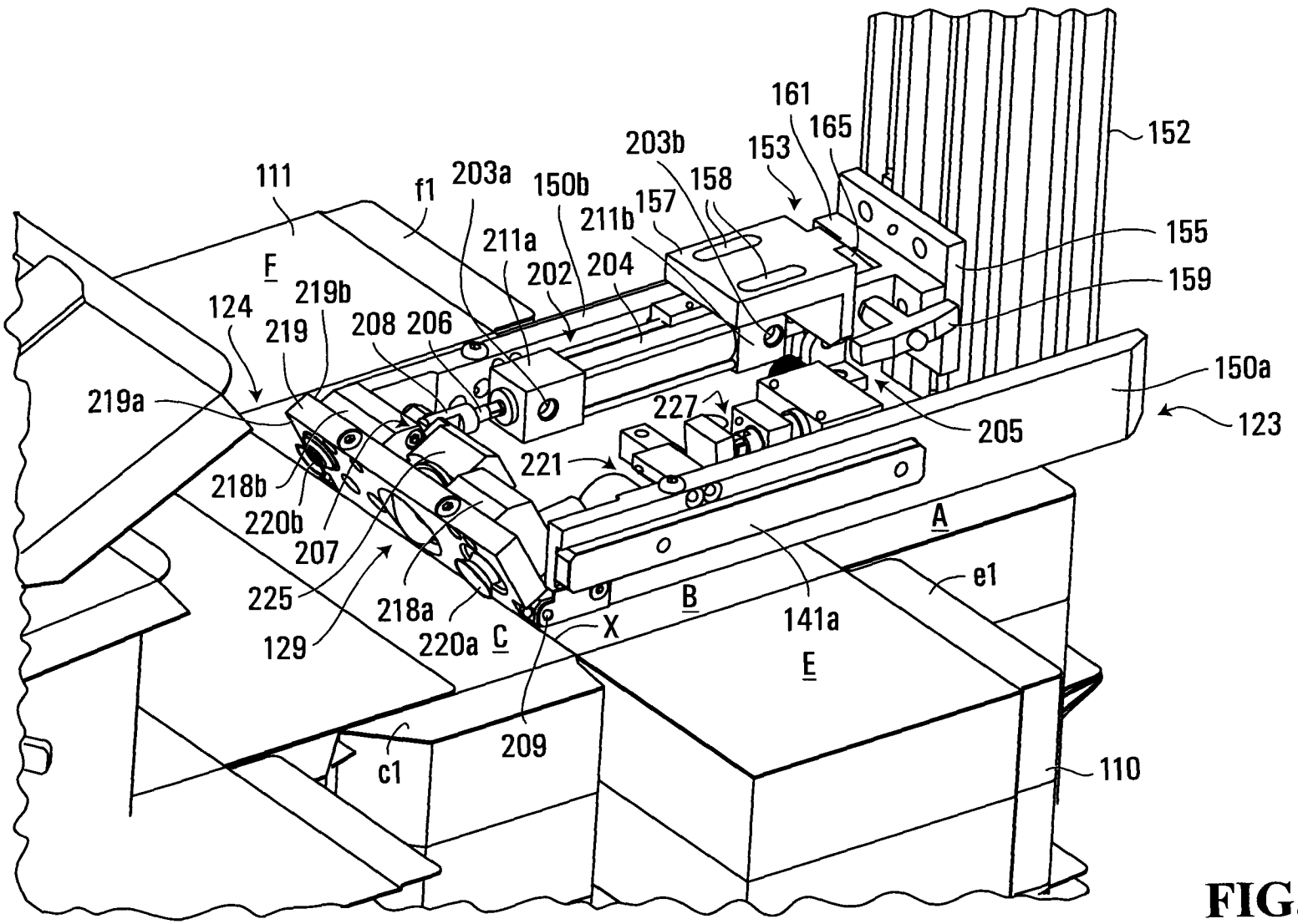

With particular reference to FIGS. 1, 8 and 9, mandrel 121 may be supported by mandrel support frame 123, which may include a pair of spaced opposed elongated and longitudinally extending side plate members 150*a* and 150*b*. Side plates 150*a*, 150*b* may be interconnected by and joined to a lower horizontally oriented plate 150*c*. Side plates 150*a*, 150*b* and lower plate 150*c* may be integrally formed together. Side plates 150*a*, 150*b* may be interconnected to respective side plates 140*a*, 140*b* of mandrel 121, with mandrel mounting brackets 141*a* and 141*b*, thus providing support for mandrel 121. Mandrel side plates 140*a* and 140*b* may for example contain a groove or channel on their inner surface for receiving mandrel support brackets or rails 141*a*, 141*b* respectively (see for example FIG. 18) so that the mandrel 121 can be supported by the mandrel support frame 123 and may be generally restrained from vertical and transverse motion. To assist in securing the vertical and transverse movement, as well as to select the appropriate longitudinal position and restrain the mandrel 121 from longitudinal movement, mandrel top plate 140*c* may be mounted to and above a mandrel support base 153.

Mandrel support frame 123 may be interconnected and supported by a vertical frame support member 152 (see for example FIGS. 1 and 9). For example, with reference to FIG. 8, lower support plate 150*c*, may have screw holes 151 which may enable screws (not shown) to pass upwards through plate 150*c* into threaded holes (not shown) in a lower horizontal surface of vertical support member 152. Vertical support member 152 may be conveniently formed from a light but relatively strong material that can be readily formed into a tube, such as for example aluminium. Vertical support member 152 may be formed as a hollow channel member that has a longitudinally extending cavity that allows for electrical and communication cables and pressurized/vacuum air hoses to pass through from an upper end to a lower end. In this way, electrical power/communication cable and air hoses can deliver power, electrical signals and air to the mandrel support frame 123 and the panel rotating apparatus 124.

Mandrel support base 153 may also be interconnected and supported by vertical frame support member 152, with support base 153 being mounted to a lower, forward facing surface area of support member 152 by for example bolts/screws.

Vertical member 152 also has an upper end portion that is interconnected to a horizontal connector member 154 for interconnecting the vertical member 152 (and the mandrel apparatus attached thereto) to the mandrel moving apparatus 125. Connector member 154 may be configured as a plate that interconnects to a corresponding slider plate 160 on mandrel moving apparatus 125. Connector member 154 may be bolted to plate 160 and may be interconnected to vertical member 152 with bracket support member.

With particular reference to FIG. 9, mandrel support base 153 is generally L-shaped and has an upper horizontal support member plate 157 and a vertical attachment leg portion 165. A quick release key bolt member 159 is provided for securing leg portion 165 to a generally U-shaped bracket member 161 that is secured to attachment plate 155 located on a forward facing surface of vertical support member 152. Key bolt 159 will pass through apertures in bracket member 161 and leg portion 165 of support base 153. Mandrel top plate 140*c* may be connected to support plate 157 using bolts or screws (not shown) that may pass through apertures 156 in mandrel top plate 140*c* (see FIG. 2), into longitudinally oriented slots 158 that pass through support plate 157. Thus, the longitudinal position of mandrel 121 relative to support frame 123 and rotating apparatus 124 can be selected by the appropriate setting of the screws in slots 158. Quick release key bolt device 159 may be used to provide for the rapid and tool free attachment and release of mandrel 121 to and from vertical frame support member 152.

Attachment of the mandrel 121 to vertical support 152 via mandrel support base 153 generally restrains mandrel 121 from movement in the longitudinal direction relative to support frame 123 and rotating apparatus 124.

Mandrel support and moving apparatus 125 may be used to support and move in reciprocating forward and rearward longitudinal movement, mandrel 121, rotating apparatus 124, vertical support member 152 and mandrel support frame 123. The mandrel moving apparatus 125 may be mounted to a support frame (not shown) with a plurality of mounting blocks 166 that are connected to a longitudinally extending guide rail support member 172 of moving apparatus 125. Also comprising part of moving apparatus 125, guide slide rails 164*a*, 164*b* may be mounted to opposite side edge faces 172*a*, 172*b* respectively of support member 172. Slider plate 160 may have mounted thereto, opposed sets of slide blocks 162*a*, 163*a*, and 162*b*, 163*b* (see FIGS. 2 and 4). Each of the slide blocks 162*a*, 163*a*, and 162*b*, 163*b* may have inwardly facing arcuate surfaces which may engage portions of their respective guide rails 164*a*, 164*b*. Slide blocks 162*a* and 163*a* may be supported by and slide along guide rail 164*a*. Slide blocks 162*b* and 163*b* may be supported and slide along guide rail 164*b*. The slide blocks and guide rails may be made of complimentary materials that allow for smooth and easy sliding of the blocks along the guide rails. For example, slide blocks may be made of aluminium and guide rails 164*a*, 164*b* may be made of stainless steel.

Moving apparatus 125 also includes a mandrel drive device 174 which may include a continuous horizontally oriented drive belt 178 that extends between and rotates around a pulley 176 and a drive wheel 180. Drive wheel 180 may be driven in both rotational directions and at varying speeds by the drive shaft of a servo drive motor 170. The operation of drive motor 170 may be controlled by PLC 132 in combination with a position sensing apparatus (not shown) so that PLC 132 can determine when and how to operate drive motor 170 to appropriately position the drive belt 178 and thus moving apparatus 125. Drive motor 170 may be mounted at an end portion of support member 172 with a vertically oriented connector plate 171.

To interconnect the drive belt 178 to slider plate 160 and/or sliding blocks 162*a-b*, 163*a-b* known attachment apparatus or mechanisms can be provided. For example, a clamp can be mounted to plate 160 and the belt 178 can be secured between clamp arms of the clamp. Thus, when the drive belt moves longitudinally, in parallel longitudinal, vertical and horizontal alignment with the guide rails 164*a*, 164*b*, the slide plate 160 and sliding blocks 162*a-b*, 163*a-b* can also move in the same direction. The result is that the mandrel support frame 152 and thus mandrel 121 can also be moved longitudinally, in parallel longitudinal, vertical and horizontal alignment with rails 164*a*, 164*b*.

Also associated with moving apparatus 125 is a caterpillar device 199. Caterpillar 199 has a hollow cavity extending along its length. Within the cavity of caterpillar 199 hoses carrying pressurized air/vacuum and electrical/communication wires can be housed. Caterpillar 199 allows such hoses and wires to move longitudinally as the mandrel support member 152 and thus mandrel 121 and mandrel support frame 123 are moved longitudinally by moving apparatus 125. The hoses and wires may extend from external sources to enter at an inlet 199*a* of caterpillar 199 and emerging at an outlet 199*b*. Once leaving outlet 199*b*, the hoses and wires may pass into the internal cavity of vertical member 152 (see FIG. 2). An example of a suitable caterpillar device that could be employed is the E-Chain Cable Carrier System made by Ignus Inc.

The next component of system 100 to be described in detail is the panel rotating apparatus 124. Panel rotating apparatus 124 may engage one blank 111 and may be employed to rotate one or more panels of blank 111 relative to one or more other panels. For example, as illustrated in FIGS. 9-11, panels C and D of a blank 111 are rotated approximately 90 degrees relative to panels A, B, E and F, from a generally flat orientation to a generally vertical orientation. Panel rotating apparatus 124 may include a panel rotation unit 129. The movement of unit can be controlled by PLC 132 in such a manner that it can rotate so as to move a panel C (and panel D which is attached to an end of panel C) of a carton blank 111 through a rotation of approximately 90 degrees, in an aligned manner, at an appropriate time, as is illustrated for example in FIGS. 9, 10 and 11.

Figure 7:
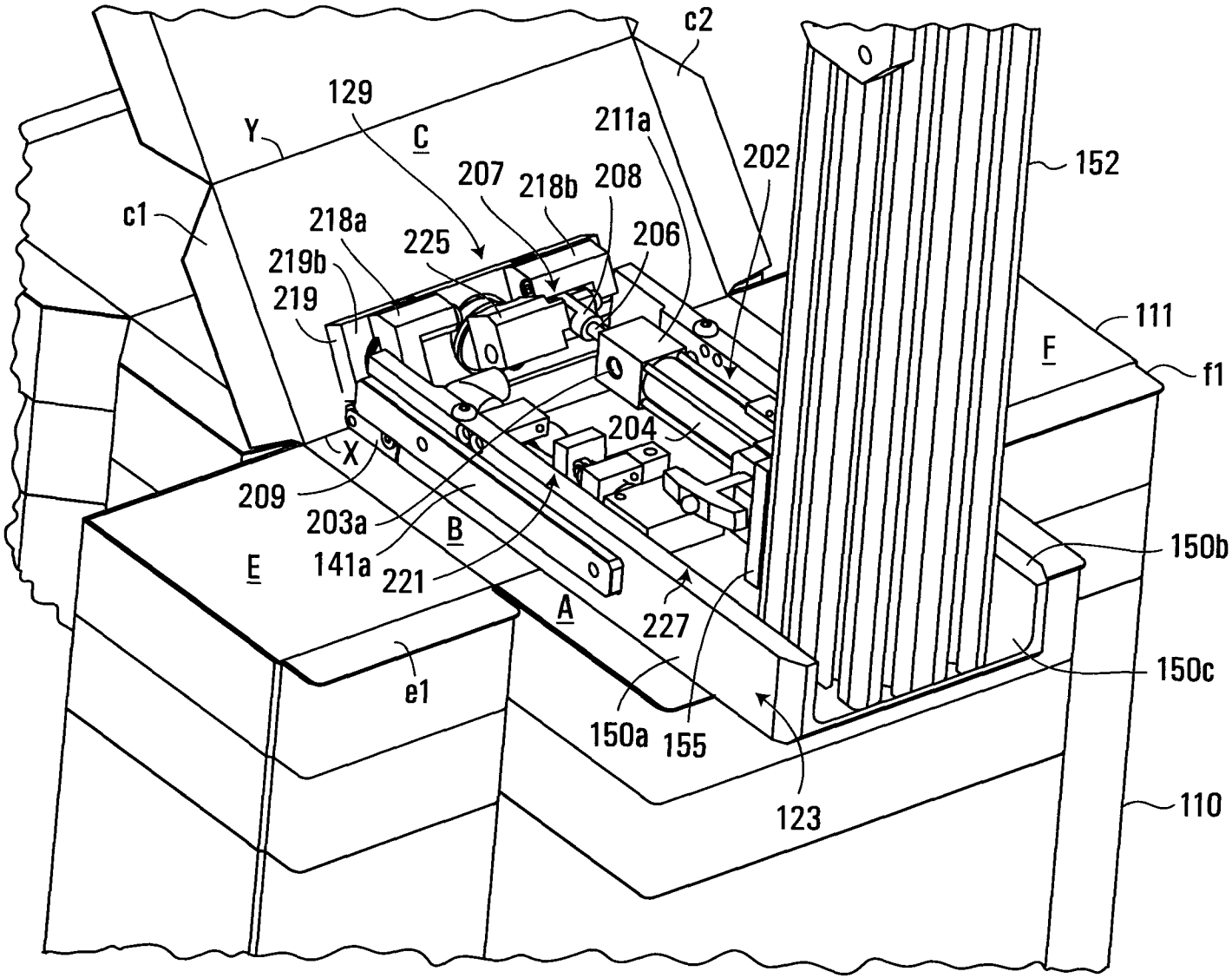

Unit 129 will be described in detail, and with particular reference to FIGS. 7, 8 and 9 which for simplicity depict system 100 without mandrel 121. The unit 129 may include a longitudinally oriented piston device 202 which has piston blocks 211*a*, 211*b* that rest on bottom plate 150*c*. Piston block 211*b* has a vertical attachment leg portion 212. A mounting block 205 with opposed generally vertical longitudinally oriented plates 214*a*, 214*b* and generally horizontal transversely oriented plate 215 is positioned at and connected to a rear end of reciprocating piston 202 with a screw (not shown) that passes through an aperture in leg portion 212 (not shown) and apertures 213*a*, 213*b* in vertical plates 214*a*, 214*b* respectively. Mounting block 205 is also mounted to plate 150*c* with screws (not shown) that pass through apertures 210 in horizontal plate 215 into the plate 150*c*.

Piston 202 may be a conventional pneumatic reciprocating cylinder 204 and is operable to move in a reciprocal movement between a fully extended position (not shown) and a retracted position as shown in FIG. 8. This reciprocating motion can be achieved in known ways such as for example, by using a double acting cylinder, which can for example, channel compressed air to two different chambers which in turn provides interchanging forward and backward acting forces on the piston 202. Piston 202 may for example be a DSNU made by Festo. Compressed air may be delivered to piston 202 by hoses (not shown) passing from vertical support member 152 out to connect with apertures 203*a*, 203*b*.

To channel the compressed air appropriately, valves (not shown) can be driven between open and closed positions by solenoids responsive to signals from PLC 132 (FIG. 1). The valves could be located proximate the piston 202 or be disposed elsewhere. Electrical lines carrying signals from PLC 132 could also pass through vertical member 152 to operate the valves.

A piston rod 206 of piston 202 is provided with an extended arm portion 208 that provides for a hinge connection 207 for pivoting the panel rotating apparatus 124 between a generally horizontal position and a generally vertical position.

Panel rotation apparatus 124 also comprises panel rotating plate 219 with outer and inner face 219*a* and 219*b* respectively. Panel rotating plate 219 may be attached by way of piano hinge 209 to forward lower extensions of side plates 150*a*, 150*b* of mandrel support frame 123. As a result of the movement of piston 202 the cylinder rod 206, will extend or retract allowing the arm 208 to pivot relative to rotating apparatus 124. The movement of piston rod 206 thus causes the panel rotating plate 219 to rotate through a certain angular distance relative to mandrel 121 around piano hinge 209.

Air suction cups 220*a* and 220*b* may be fixedly mounted to outer or forward facing face 219*a* of panel rotating apparatus plate 219 with mounting block units 218*a*, 218*b* respectively. Air suction cups 220*a* and 220*b* may be interconnected through block units 218*a*, 218*b* to a source of vacuum by providing for an air channel linked to a manifold unit 225. The manifold unit 225 may in turn may be interconnected by air vacuum supply hose (not shown) to a pressurized air distribution unit generally designated 227. Unit 227 may include a plurality of valves that may be operated by PLC 132 and may also include a vacuum generator apparatus 221. If a vacuum generator is utilized, pressurized air may be delivered from an external source through vertical support member 152 to unit 227. The vacuum generator will then convert the pressurized air to a vacuum that can then be delivered to suction cups 220*a*, 220*b*.

The air suction force that may be developed at the outer surfaces of suction cups 220*a* and 220*b* of unit 124 may be sufficient so that when activated they can engage, hold and rotate panel C of a blank 111 from a generally horizontal position to the position shown in FIG. 11. The vacuum generated at suctions cups 220*a* and 220*b* can also be de-activated by PLC 132.

The suction cups 220*a* and 220*b* of unit 124 may engage the surface of panel C. In other embodiments suction cups of rotation units may alternatively, or in combination also, engage panel D. The particular arrangement of suction cups on rotating plate 219 can be designed based upon the configuration of the carton blank and the particular panels that need to be rotated. It will also be appreciated that in the panel rotation apparatus 124, suction cups are used to apply a force to hold and/or move a panel of a carton blank. However alternative engagement mechanisms to suction cups could be employed. It should also be noted that a second set of suction cup/suction plates mounted for movement, including pivoting movement, could be deployed to perform additional panel folding or movement and/or holding of the panel and blank.

More generally, other types of apparatus may be employed to transfer a blank 111 to the mandrel apparatus 120, such that one portion of the blank may be rotated, preferably about ninety degrees, relative to another portion of the panel, to set-up the folding process using a folding apparatus.

With particular reference to FIGS. 13-18, system 100 may also include a panel folding and guide apparatus 130, that may be a rail and plough apparatus generally designated 300. Rail and plough apparatus is configured to cause the appropriate panel and sealing flaps of a blank 111 to be appropriately folded and sealed to produce a carton configuration that is suitable for delivery to a carton conveyor (not shown). Apparatus 300 may, as shown in the figures, include a plurality of rails and plough devices. Each of the rails and plough devices of apparatus 300 may be supported by rods or bars interconnected to a support frame (not shown for simplicity in the figures).

Apparatus 300 may include a pair of spaced, longitudinally extending overhead rails 302*a*, 302*b* configured and positioned so that as blank 111 is moved longitudinally forward by mandrel apparatus 120, rails 302*a*, 302*b* may fold panel D and attached flaps d1, d2 and d3, from a generally vertical orientation to a generally horizontal orientation. Apparatus 300 may also include a pair of opposed wedge plough devices 310*a*, 310*b* that may be configured and positioned so that as blank 111 is moved longitudinally forward by mandrel apparatus 120, plough devices 310*a*, 310*b* can commence the generally inward folding of outer panels E and F respectively from a generally horizontal orientation towards a generally vertical orientation.

A pair of opposed inner side rails 304*a*, 304*b* are configured and positioned to engage flaps c1 and c2 respectively and may fold and maintain the flaps c1 and c2 in a rearward longitudinal direction, until outer panels E and F have been brought into an upward vertical and overlapping relationship.

Also part of apparatus 300 are a pair of opposed, upwardly and inwardly oriented guide rails 308*a*, 308*b*, that are configured and positioned to take over from plough devices 310*a*, 310*b*, to engage the lower surfaces of panels E and F and to complete the inward folding of outer panels E and F respectively to a vertical position.

A pair of opposed, generally downwardly and inwardly oriented guide rails 306*a*, 306*b* are configured and positioned to provide inward and downward folding of flaps d2 and d3 respectively to a vertical position as blank 111 continues the movement longitudinally. Also, a pair of lower support rails 312*a* and 312*b* are positioned to assist in supporting blank 111 once it has been removed from the support of the stack of blanks 111 in the magazine 110.

It should also be noted that during the forward longitudinal movement of blank 111 as it is pushed by mandrel apparatus 120 through the positions illustrated in FIGS. 15-18, opposed adhesive compression rails 314*a*, 314*b* which are configured and positioned to apply pressure to the side panels of the formed carton, to ensure appropriate sealing of the flaps and panels with the adhesive.

Adhesive applicators such as applicators 400 can be appropriately positioned and their operation may be controlled by PLC 132. Applicators 400 can apply a suitable adhesive to various panels and/or flaps so that when the panels and flaps are folded as described herein, the panels and flaps can be held in the desired carton configuration. An example of a suitable applicator that can be employed is the model ProBlue 4 applicator made by Nordson Inc. An example of a suitable adhesive that could be employed with on a carton blank 111 made of cardboard is Cool-Lok adhesive made by Nacan Products Limited.

Figure 14:
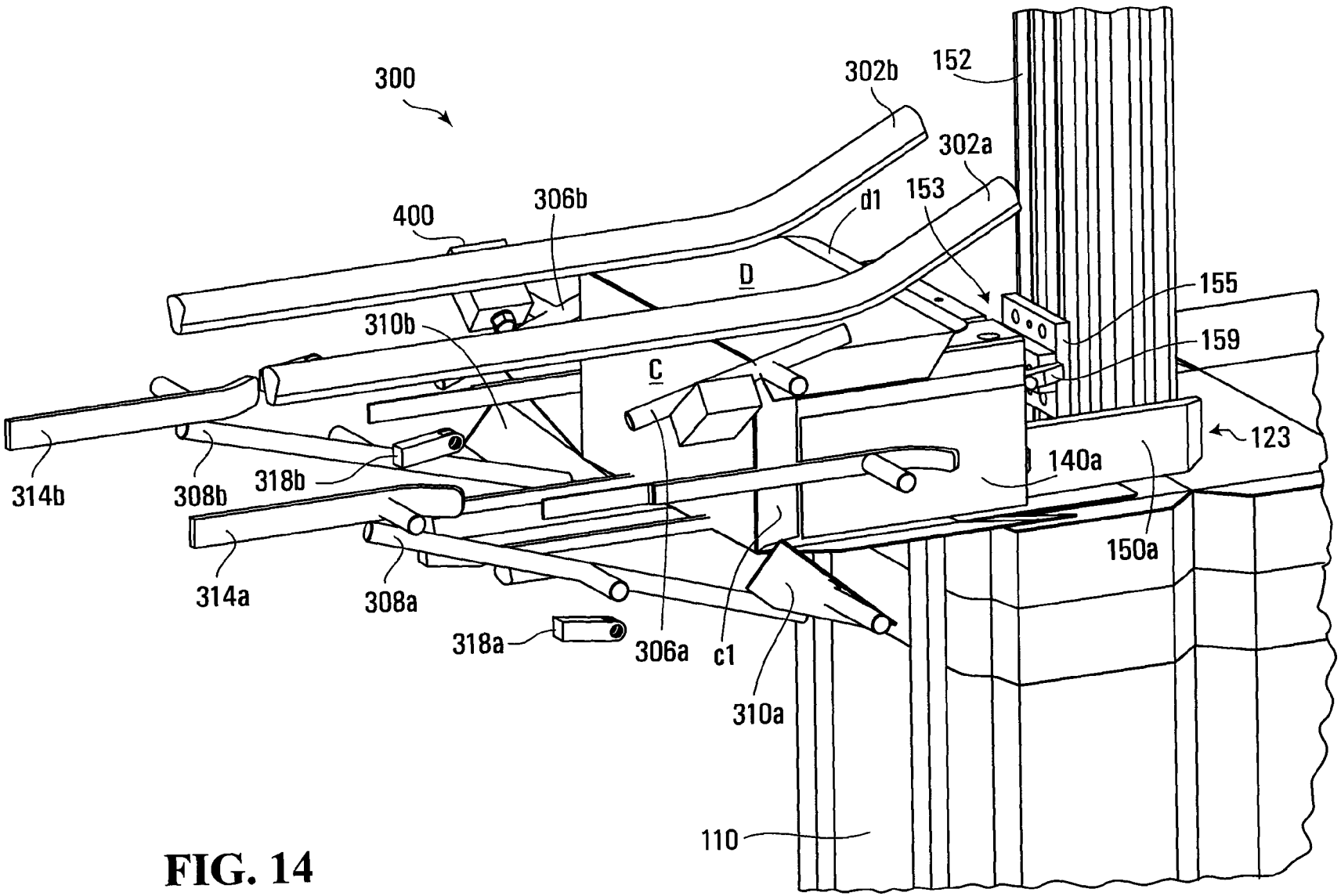
Figure 15:
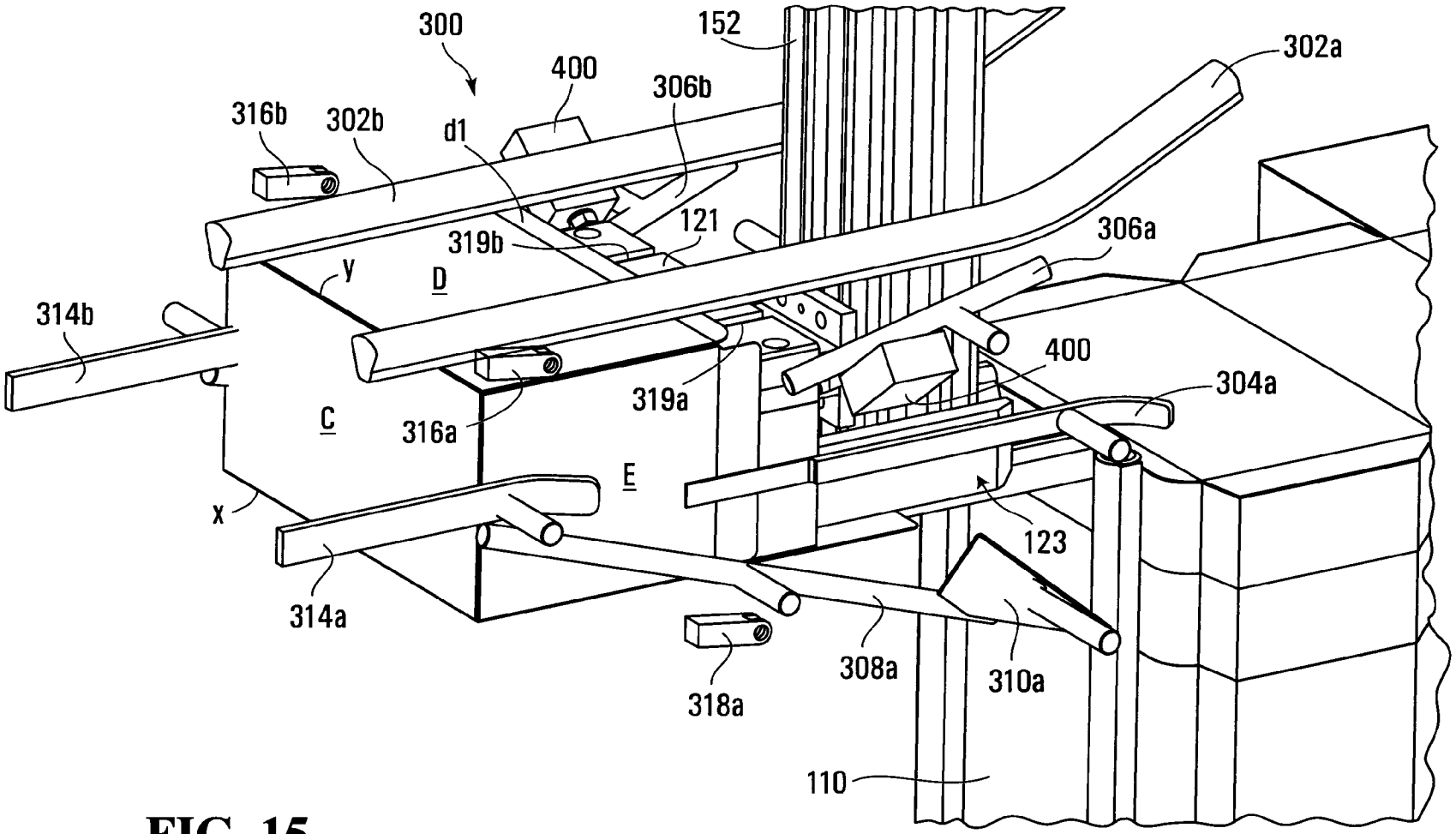

Also with particular reference to FIGS. 14 and 15, associated with rail apparatus 300 are opposed pairs of upper latch devices 316*a*, 316*b* and lower latch devices 318*a*, 318*b*. The latch devices 316*a*, 316*b* may be gravity driven or spring loaded finger latches which permit one way movement of configured cartons. Top plate 140*c* of mandrel 121 may be inscribed with grooves 319*a* and 319*b*, and similarly the lower facing surface of lower support plate 150*c*, may also be inscribed with corresponding grooves (not shown). As the carton blank is pushed forward, the latches are pushed by panels D, B and A to positions allowing the carton blanks to pass the upper latch devices 316*a*, 316*b* and lower latch devices 318*a*, 318*b*. However, once the rear edges of upper panel d1 and lower panel A have passed the upper and lower latches respectively, the latches will fall into the respective grooves. This will then prevent rearward movement of the configured blank 111*a* and allow for retraction of mandrel 121 without physical impairment by upper latch devices 316*a* and 316*b* or lower latch devices 318*a*, 318*b*. It will also be appreciated that other known types of mechanisms could be deployed that would restrain the blank from rearward movement, when the mandrel apparatus is starts to move backwards and disengages from the blank to return to its start position where the next blank can be retrieved from magazine 111. For example, additional suction cups could be used that are controlled by valves and PLC 132 and that are positioned to engage and hold the blank (which has become a formed carton) in position during disengagement of the mandrel 121 from the formed carton.

Various components of system 100 such as mandrel 121, mandrel moving apparatus 125, panel rotating apparatus 124 and mandrel support frame 123 may be made of suitable materials such as for example mandrel 121 may be made from aluminium. Also a least some of the various components of system 100 such as mandrel 121 and support frame 123 may be integrally formed or interconnected to each other by known techniques. For example if the components are made of a suitable metal or plastic, welding techniques can be employed. Also, the use of screws and/or bolts may be employed.

The operation of system 100 will now be described in detail. First, magazine 110 may be raised so that the upper generally horizontally oriented surface of the upper-most blank 111 is just in contact with, or is a very short distance spaced from (e.g. within ¼ inch) the bottom surfaces of mandrel support frame 123 and mandrel 121. Next, magazine 110 and panel rotating apparatus 124 may co-operate so that the single blank 111 from the top of the stack of carton blanks may be retrieved from the magazine 110 and be transferred to the mandrel apparatus 120. Thus, in this way the panel rotating apparatus 124 may also serve as a transfer mechanism for transferring carton blanks in series from the magazine 110 to the mandrel 121. In other embodiments, a separate transfer mechanism may be provided to retrieve blanks serially from the magazine and transfer them to the mandrel so that a rotating apparatus may rotate a portion of the blank as hereinafter described.

As shown in FIGS. 9, 10 and 11, under the control of PLC 132, panel rotation unit 124 may extend reciprocating piston rod 206 so that the rotating plate 219 and the suction cups 220*a*, 220*b* thereon are rotated to be in an orientation that is downward facing. Upon coming into close proximity or contact with panel C, suction cups 220*a*, 220*b*, may engage the upward facing surface of panel C of the top blank 111 in the stack. Panels A and B of the blank 111 are at the same time are maintained generally in position up against or proximate the lower surface of mandrel support frame 123. Suction cups or another additional holding mechanism (not shown) could also be employed to hold the panels A, B, E, and F horizontally against the bottom surfaces of the mandrel. Panels A, B, C and D may also continue to be supported underneath by physical contact with the upper surface of another underlying blank 111 in the stack.

With particular reference now to FIGS. 9, 10 and 11, mandrel support frame 123, panel rotating apparatus 124 may be operated by PLC 132 to rotate rotating plate 219 about hinge 209 so that panels C and D may be rotated—preferably approximately ninety (90) degrees—about a pre-determined fold line X between panel B and C. Thus panels C and D are rotated relative to panels A, B, E and F, from a generally flat and horizontal orientation to a generally vertical and angled orientation, thus forming a generally L-shaped configuration. It is this step that makes the rest of the carton forming process using system 100 possible.

Vacuum may also be applied to suction cups 220*a*, 220*b* through operation of PLC 132 during the rotation of the panels C and D. The air suction force that may be developed at the outer surfaces of suction cups 220*a*, 220*b* of panel rotation apparatus 124 may be sufficient so that panels C and D of a blank 111 can be rotated from the position shown in FIG. 9, through the intermediate position shown in FIG. 10, to the position shown in FIG. 11.

Once panel C reaches the position shown in FIG. 11, the suction cups 220*a*, 220*b* associated with panel rotating apparatus plate 124 hold panel C against the forward facing surfaces of mandrel side plates 140*a*, 140*b* and the outer surface of 219*a* of panel rotating plate 219 with panel D also generally remaining in a vertical orientation. It should be noted that the folding of panel C relative to panel B takes place about fold line X. While there may be a predetermined fold line Y between panel C and panel D, until one is bent relative to the other, panels C and D will tend to remain in the same general plane.

The rotation of panels C and D will also tend to pull that blank upwards and perhaps a very small distance forward, the effect of which may be to free the top blank from the blank beneath it that is still on the stack. The result is that the top blank is now capable of being moved forward by the mandrel apparatus 120 towards the rail and plough apparatus 300.

It will be appreciated that in some embodiments, the system could be configured so that magazine 110 may discharge blanks 111 to a mandrel apparatus like apparatus 120 from the top rather than the bottom. However, discharging blanks from the top may require inverting some or all of the aforementioned components.

Next, mandrel support and moving apparatus 125 may be used to move mandrel apparatus 120 and mandrel support frame 123 longitudinally forward towards rail and plough apparatus 300, thus also moving blank 111 that is held to mandrel 121. To create this forward longitudinal movement of the mandrel apparatus 120, PLC 132 can operate servo drive motor 170, to move drive belt 178 longitudinally in a direction that causes slider plate 160 to slide forward on guide rails 172*a*, 172*b*. With the movement of slide plate 160, the vertical support 152, mandrel support frame 123, and mandrel apparatus 120 that is attached to frame 123, also move longitudinally towards rail and plough apparatus 300.

Figure 13:
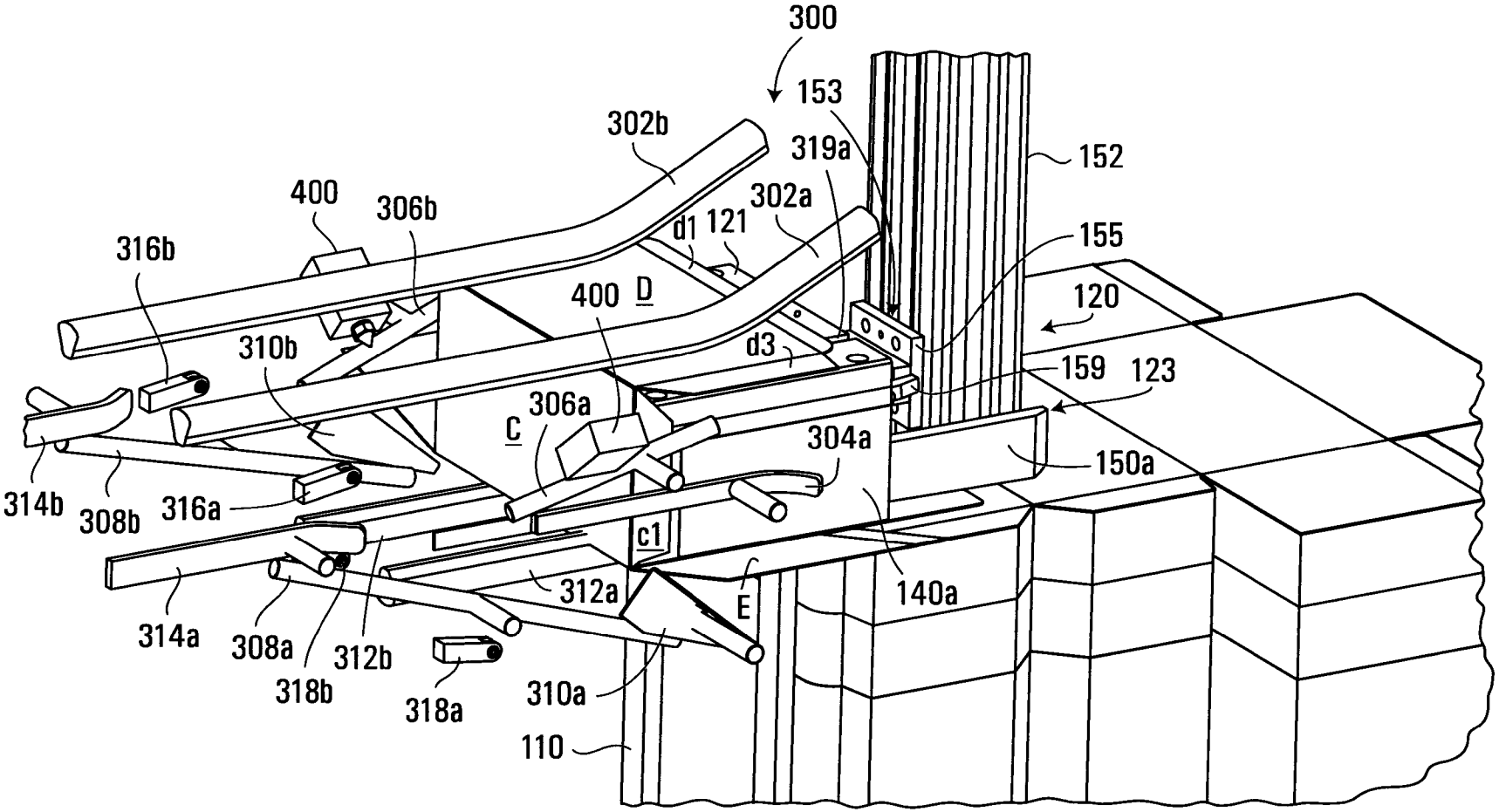

With particular reference now to FIGS. 12-17, mandrel 121 is moved longitudinally forward, and thus blank 111 which may be secured thereto by the interconnection of panel C to front surface of the plate 219*a*, also moves longitudinally with the mandrel 121. As blank 111 is moved longitudinally by mandrel apparatus 120, first rails 302*a*, 302*b* may engage a portion of panel D, so that panel D and attached flaps d1, d2 and d3, are folded along fold line Y downward from a generally vertical orientation to a generally horizontal orientation as shown in FIG. 13 whereby panel D is held against the upper surface of mandrel plate 140*c*.

With continued longitudinal movement of blank 111, opposed inner side rails 304*a*, 304*b* may engage flaps c2 and c1 respectively and may fold and maintain the flaps c1 and c2 in a generally rearward longitudinal orientation. At about the same time, a pair of wedge plough devices 310*a*, 310*b* may commence the generally inward folding of outer panels E and F respectively from a generally horizontal orientation towards a generally vertical orientation.

As shown in FIGS. 14 and 15, with continued longitudinal movement of mandrel 121 and blank 111 secured thereto, next opposed, upwardly and inwardly oriented guide rails 308*a*, 308*b*, may take over from plough devices 310*a*, 310*b*, to engage the lower surfaces of panels E and F and to complete the inward folding of outer panels E and F respectively to a vertical position as shown in FIG. 15. It should be noted that in FIG. 14, mandrel 121 shown only for illustrative purposes detached from the rear surface of panel C. Of course, during the actual movement of mandrel 121 forwards through folding apparatus 121, in operation, the mandrel 121 will typically remain in very close proximity or actual contact with panel C, as the blank 111 is pushed through the folding apparatus 130. Also, generally downwardly and inwardly oriented guide rails 306*a*, 306*b* may provide inward and downward folding of flaps d3 and d2 respectively to a generally vertical downward position.

Lower support rails 312*a*, 312*b* may assist in supporting blank 111 once it has been removed from the support of the stack of blanks 111 in the magazine 110.

Figure 16:
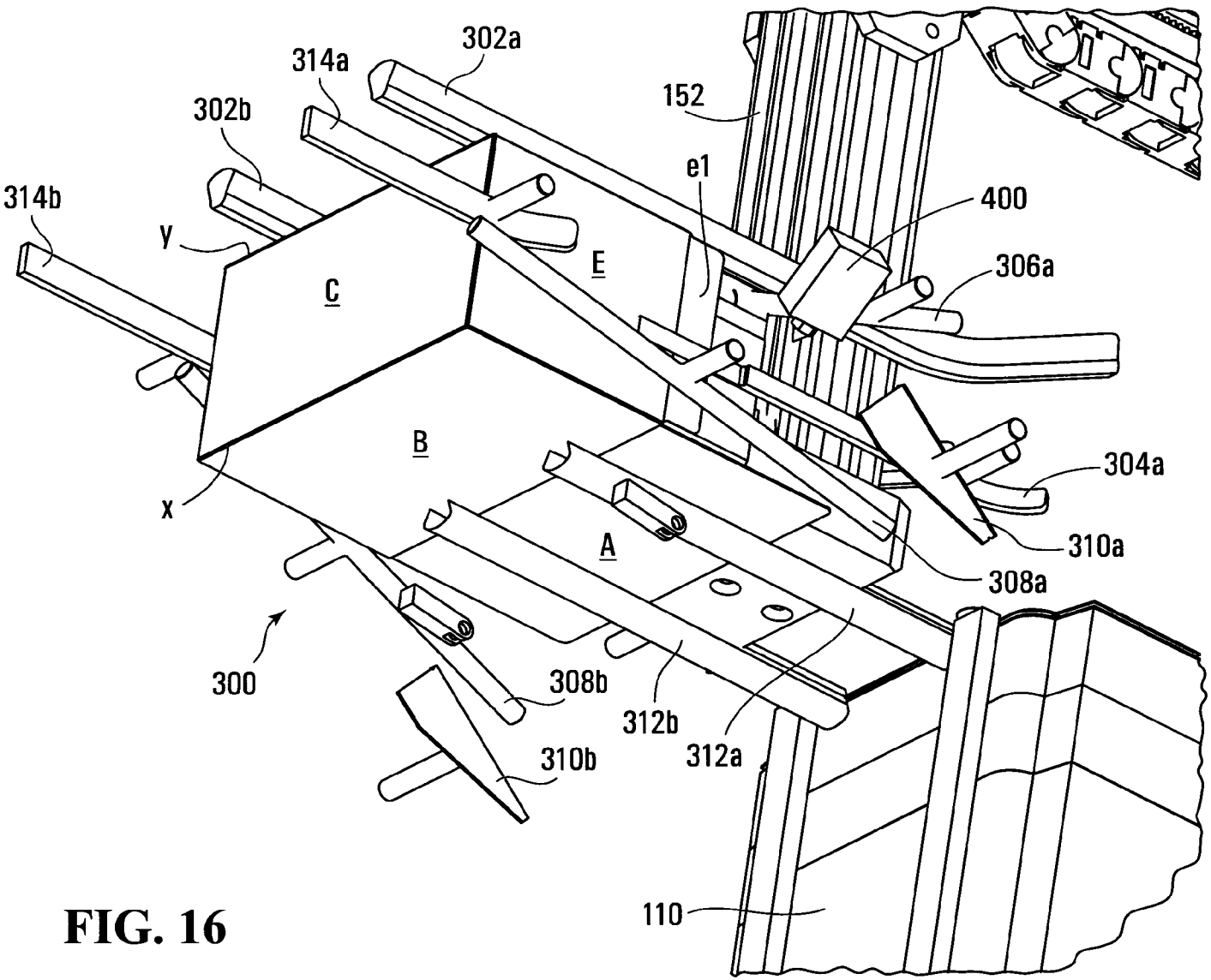
Figure 17:
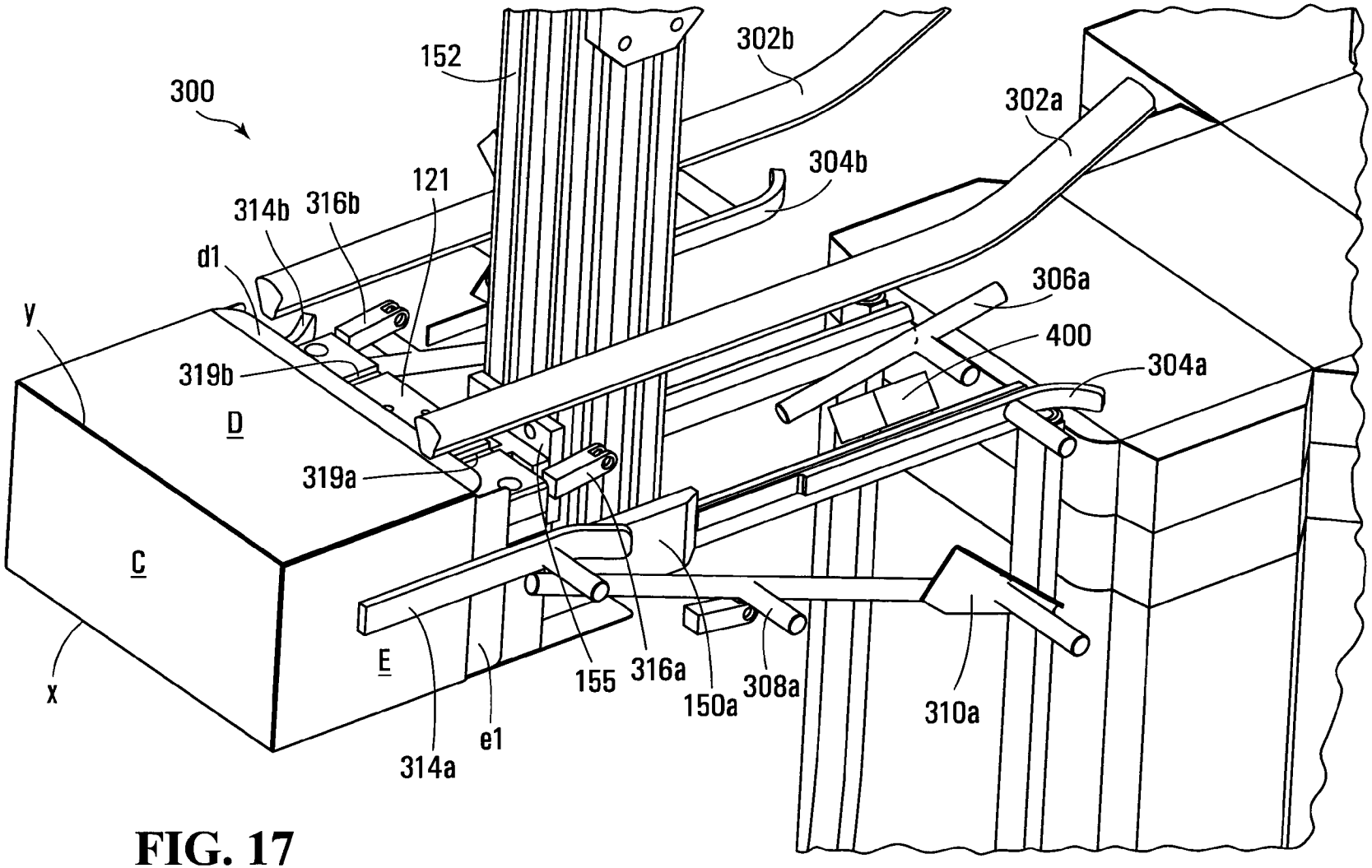
Figure 18:
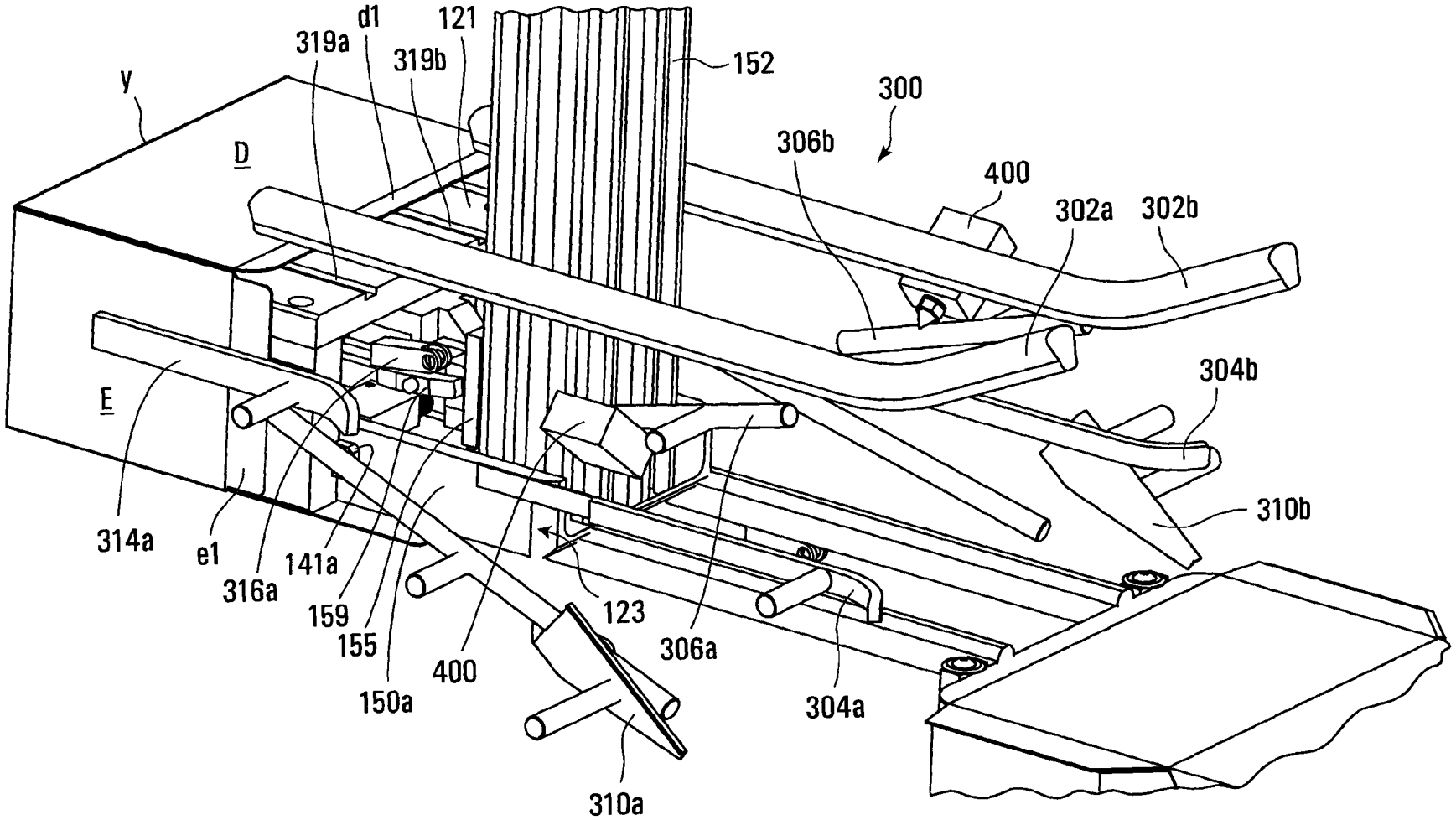

Also as shown in FIGS. 16, 17 and 18, as blank 111 moves longitudinally, the side panels E and F are compressed in such a manner that the portions of panel E engage surfaces of flaps d3 and c1, and portions of panel F engage surfaces of flaps c2 and d2. With the assistance of adhesive positioned between the respective surfaces, compression rails 314*a*, 314*b* may help ensure appropriate sealing of the flaps and panels.

Under the control of PLC 132, or pursuant to another control or trigger, adhesive applicators 400 can apply a suitable adhesive at appropriate positions on the panels and/or flaps so that when the panels and flaps are folded as just described, the panels and flaps can be held in the desired carton configuration.

As is shown in FIGS. 16, 17 and 18, as blank 111 moves further in a longitudinal direction, the folded blank, with panels secured appropriately with for example adhesive, will move past the end of overhead rails 302*a*, 302*b* and upward rails 308*a*, 308*b*. Also, as shown in FIG. 17, the rear edge of rear panel A will pass lower latch devices 318*a*, 318*b*, and the rearward edge of flap d1 will pass upper latch devices 316*a*, 316*b*. This longitudinal positioning of blank 111 may cause latch devices 316*a*, 316*b*, 318*a*, 318*b* to be activated.

Once activated, the latch devices may restrict the carton from moving longitudinally backwards, when the mandrel apparatus 120 is withdrawn.

Additionally, upon receiving the signal from the position sensor that the blank has reached the release position as shown in FIG. 18 (i.e. the mandrel has reached the end of its stroke cycle), PLC 132 will send a signal to servo motor 170 causing it to reverse its rotational direction, which in turn causes drive belt 178 to move in the opposite direction. This movement of belt 178 causes slider plate 160 and thus mandrel support frame 123 and mandrel apparatus 120 to also move in a reverse or rearward direction (not shown). Additionally, PLC 132 will send appropriate signals to deactivate the vacuum force provided at suction cups 220*a* and 220*b* in panel rotating apparatus plate 219 so that the container is no longer held on the mandrel by the suction cup forces.

Once the mandrel 121 has been withdrawn from the blank (which has now been formed into a container—carton—111*a*), the container 111*a* may no longer be supported, except possibly at least to some extent by compression rails 314*a*, 314*b*. Thus, container 111*a* may be transferred to a carton conveyor (not shown) that is configured to receive the container and the container is then carried away by the carton conveyor to be loaded and/or processed further. Carton conveyors are well known in the art and any suitable known carton conveyor may be utilized.

A device may be employed to push the container 111*a* (eg. Carton) out from between rails 314*a*, 314*b*. For example, a simple push down cylinder device that may also be controlled by PLC 132 may be used. Other examples of transfer devices that might be employed to transfer the carton from the end of guide apparatus 130 to a carton conveyor include a "blow-off" system that may use one or more jets of compressed air, a suction cup system, the use of pushing arm or simply allowing for freefall of the formed carton.

While the container 111*a* is being transferred to the carton conveyor, the mandrel apparatus 120 can be returned to its start position (not shown), ready to recommence the process that has just been described above to form another carton.

It is anticipated that cartons may be formed at a rate of in the range of about 1 to about 60 cartons per minute.

Many variations of the embodiments described above are possible. By way of example only, one portion of the blank may not have to be rotated from a generally flat configuration with the rest of the carton blank, ninety degrees relative to remaining portions of the panel, to set-up the folding process. In some other embodiments, the initial rotation of one portion of the blank from a generally flat configuration of the entire blank, may for example be only in the range of from forty-five degrees to ninety degrees. Once the first portion has been rotated from the flat configuration to the angled position, the blank is then more readily capable of being engaged by other mechanisms such that a further rotation of the first portion and other portions of the blank can be carried out to bring the first portion to a vertical position against the front face of the mandrel. Alternatively, in some applications a mandrel might be employed which has outer surfaces that are not completely at rights angles to each other. A carton blank could then be utilized in the system such that when folded, the blank may not form a cuboid shape.

The system could, with some other modifications, be provided in other spatial orientations such as in a vertically inverted configuration. In such a vertically inverted configuration, a magazine may hold blanks in a stack but be configured to dispense the blanks from the bottom of the stack. A blank could then be retrieved from the bottom of the stack and the front panels could be rotated ninety degrees downwards (instead of upwards) to engage a mandrel, so that like in the embodiment described above, an L-shaped configuration is formed around the mandrel. In some such embodiments, a separate rotation device may not be required to rotate the front panels ninety degrees to engage the mandrel. Once released from the magazine, the front panels may rotate and pivot downwards. Suction cups or another holding mechanism could then be employed to hold the front panels vertically against the front surface of the mandrel. An additional holding mechanism could also be employed at a top plate of the mandrel so that the L-shaped blank is held to the mandrel before and during its passage through a holding apparatus. Such a holding apparatus may be simply the inverted configuration to the holding apparatus described above. An example of such an embodiment is illustrated in FIGS. 19 and 20.

Figure 19:
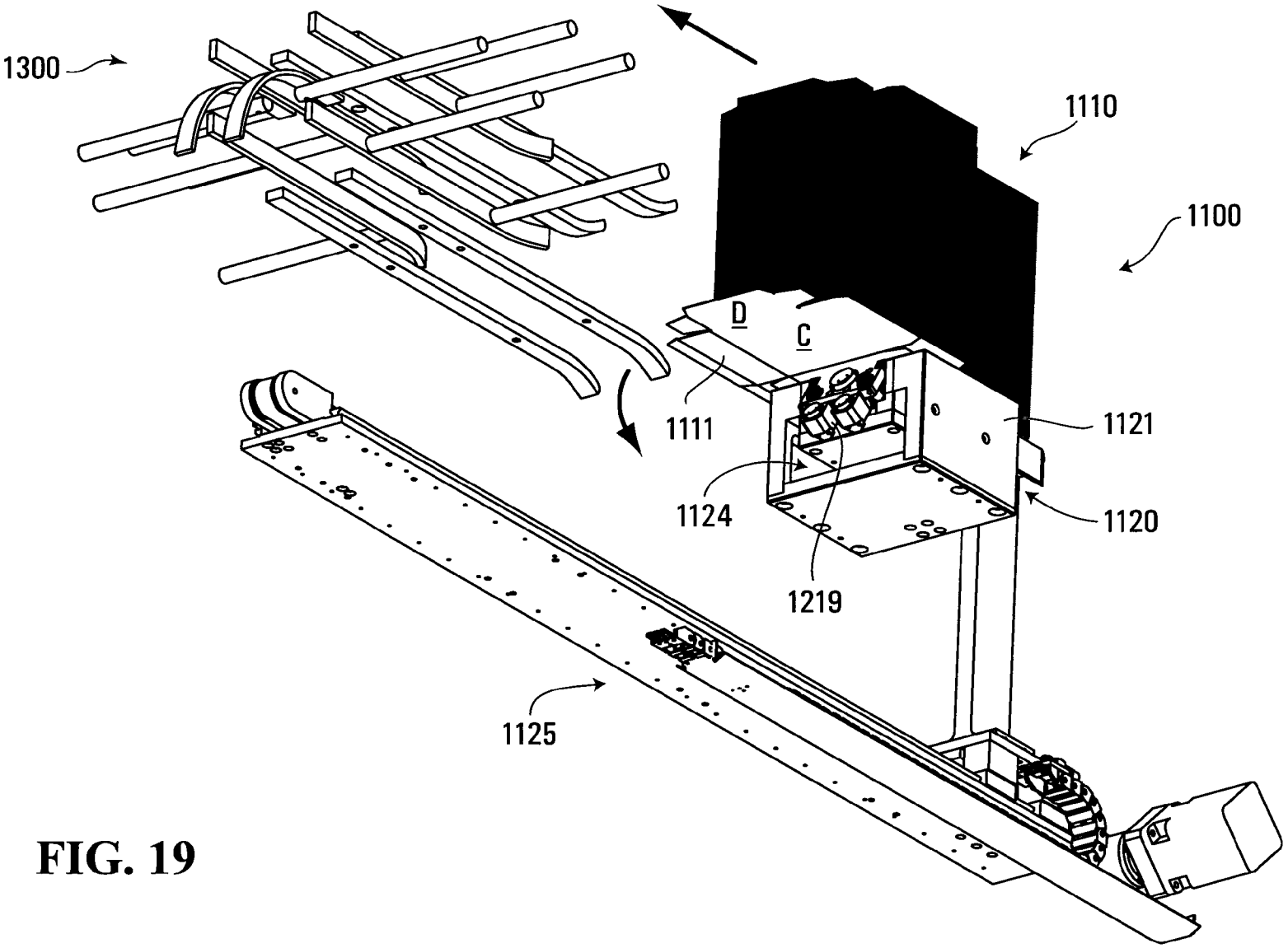
FIGS. 19 to 20 are perspective view of a first alternate system.
Figure 20:
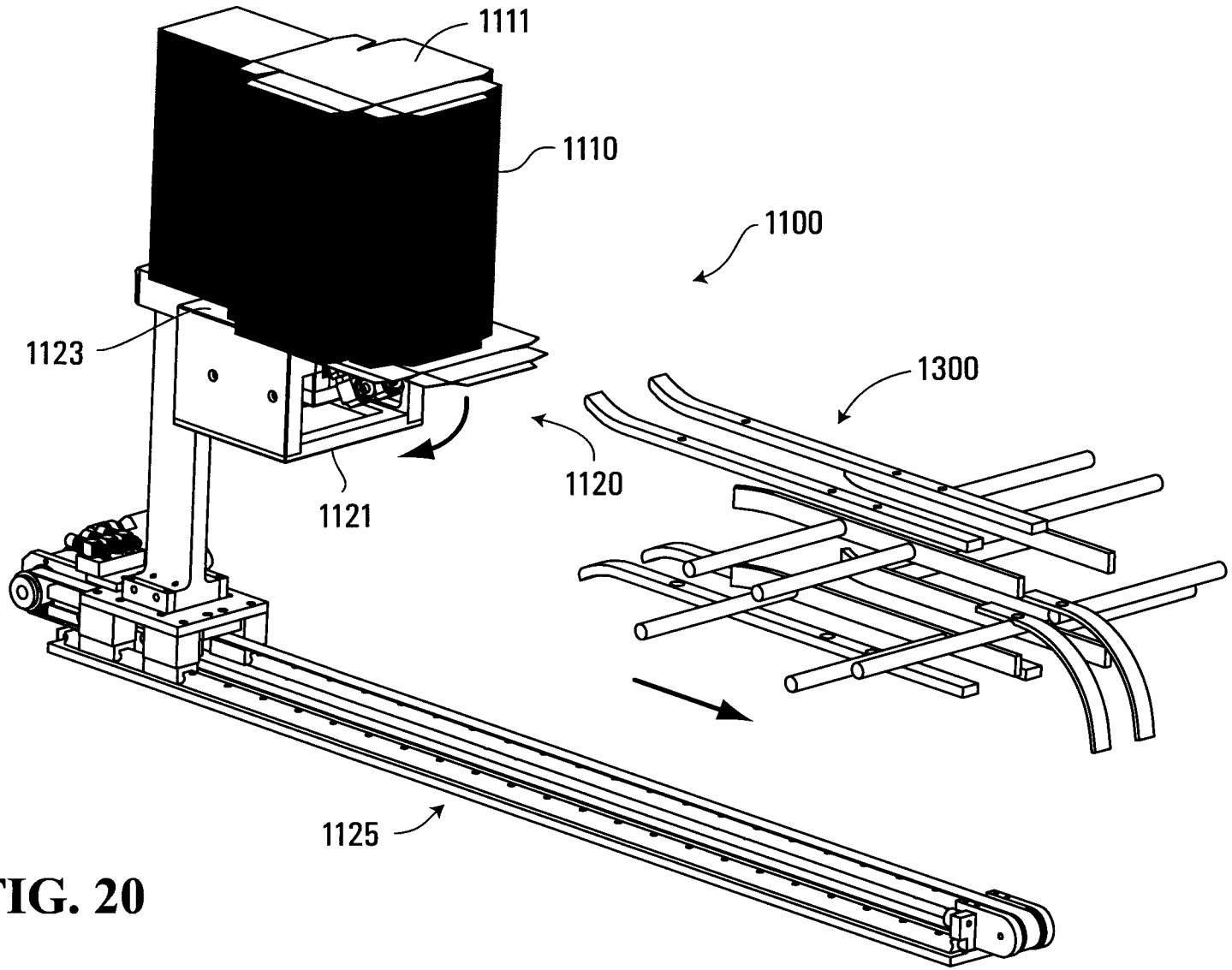

With reference to FIGS. 19 and 20, system 1100 is constructed substantially the same way as system 100 as illustrated in FIGS. 1 to 18 with generally all the same components. However, the orientation of system 1100 is vertically inverted in its orientation compared to system 100. Therefore, while each blank 1111 of system 1100 (each of which may be like blank 111) is moved longitudinally in a generally horizontal direction, the process and components are vertically inverted about a horizontal longitudinal axis.

System 1100 therefore may have a magazine 1110 holding blanks 1111 vertically above mandrel apparatus 1120, panel rotating apparatus 1124 and mandrel movement and support apparatus 1125. Mandrel apparatus 1120 may be constructed like mandrel apparatus 120 with a mandrel 1121, but may be oriented in a vertically inverted configuration compared to apparatus 120. Likewise panel rotating apparatus 1124 and mandrel movement and support apparatus 1125 may be constructed like panel rotating apparatus 124 and mandrel movement and support apparatus 125 respectively, but each is also oriented, vertically inverted. System 1100 may also include a panel folding and guide apparatus 1300 that may be a rail and plough constructed like apparatus 300, but again it may be vertically inverted.

In operation of system 1100, magazine 1110 may provide blanks 1111 in a stack such that there is a downwardly facing, but generally horizontally oriented surface of panel C in the bottom-most blank in the stack that is just in contact with, or is a very short distance spaced from the bottom surfaces of mandrel 1121. Next, magazine 1110 and panel rotating apparatus 1124 may co-operate so that the single blank 1111 from the "bottom" of the stack of blanks may be retrieved from the magazine 1110 and be transferred to the mandrel apparatus 1120. It should be noted that in this embodiment, gravity may assist in releasing a blank 1111 from magazine 1110 and securing it to mandrel 1121.

As with the embodiment of FIGS. 1-18 described above, a PLC like PLC 132 may cause panel rotation unit 1124 to extend so that a rotating plate 1219 and the suction cups thereon are rotated to be in an orientation that is upward facing. Upon coming into close proximity or contact with a panel C, suction cups may engage the downward facing surface of panel C of the bottom blank 1111 in the stack. The blank 1111 may also at the same time be supported proximate the upper surface of the mandrel support frame 1123.

Thereafter panel rotating apparatus 1124 may be operated to rotate plate 1219 so that panels C and D may be rotated—preferably approximately ninety (90) degrees—downwards, but otherwise generally as described above, to form a generally L-shaped configuration. Vacuum may also be applied to suction cups through operation of the PLC during the rotation of the panels C and D. The air suction force that may be developed at the outer surfaces of suction cups of panel rotation apparatus 1124 may be sufficient so that panels C and D of a blank 1111 can be rotated from the position shown in FIG. 19 to a vertical position.

Once panel C reaches the vertical downward position, the suction cups associated with panel rotating apparatus plate 1124 hold panel C against the forward facing surfaces of mandrel 1121 with panel D also generally remaining in a vertically downward orientation.

The rotation of panels C and D will also tend to pull that blank downwards and perhaps a very small distance forward direction, the effect of which may be to free the blank from magazine 1110. The result is that the "bottom" blank is now capable of being moved forward by the mandrel apparatus 1120 towards the panel folding and guide apparatus 1300. The magazine may again comprise a stack of blanks held in position by vertical rails (not shown). Here, where the carton former takes blanks from the bottom of the stack, gravity may bring the cartons to the bottom of the magazine. At the bottom of the stack, there may be small metal tabs attached to the rails (not shown) that protrude out into the plane of the stack such that the stack will rest on the tabs. In essence, the stack is held up by the tabs against or closely proximate to the top of the mandrel. When the panel rotation device 1124 engages the bottom carton blank and rotates the front panel downwards, the bottom carton blank may be pulled through the tabs and out of the magazine. The tabs themselves may remain stationary, but because the carton blank may be flexible, so that the carton blank will bend from the force of the rotation device and pull out of the magazine. In this way, the system may prevent more than one blank at a time from being taken. Of course various other embodiments of how a magazine can be set up and how a carton can be taken from a magazine.

Thereafter, the panel folding and guide apparatus 1300 will cause the blank to be folded in the same manner as described above in relation to rail and plough apparatus 300, but in an orientation that is vertically inverted.

Figure 21:
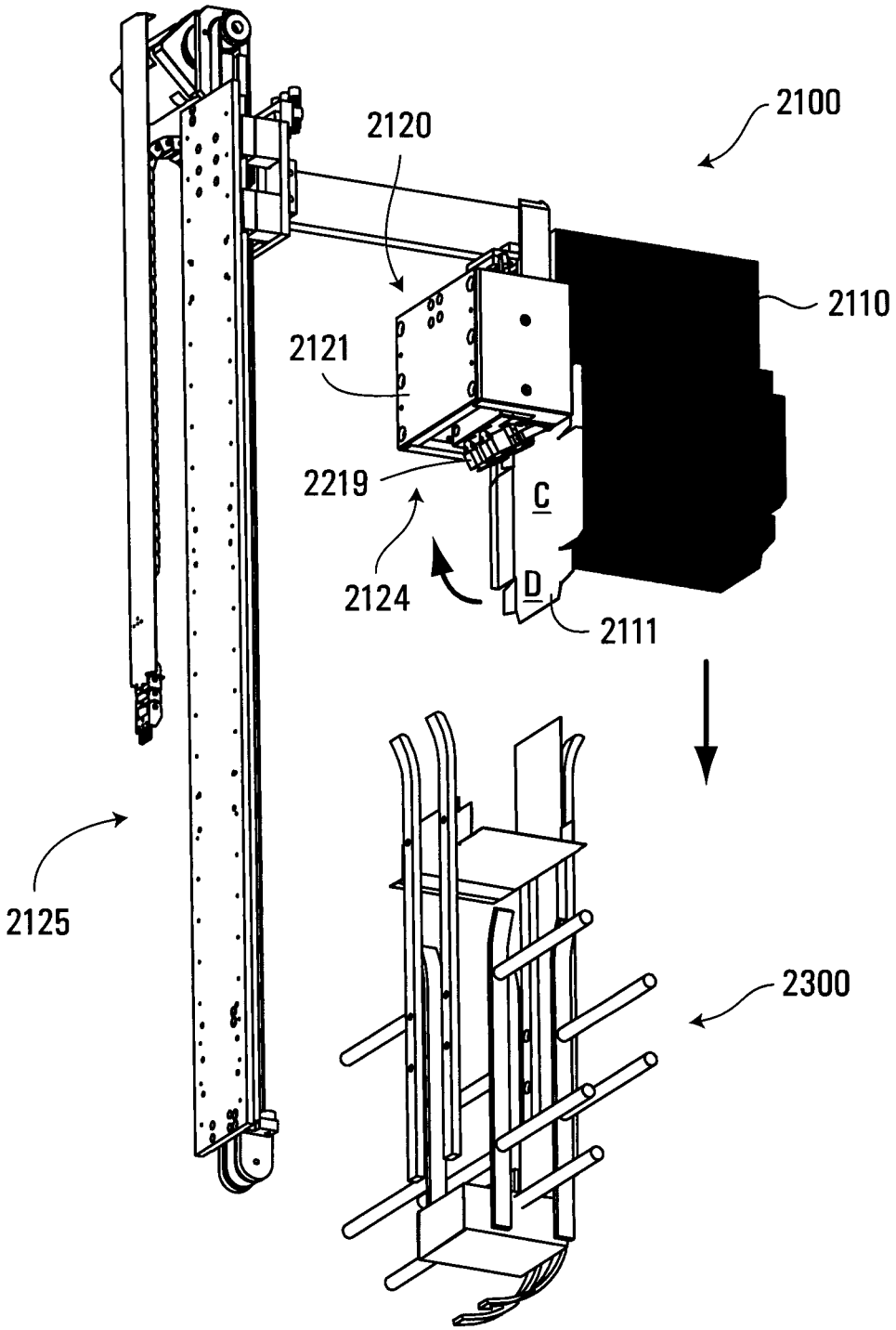
FIGS. 21 to 22 are perspective view of a second alternate system.
Figure 22:
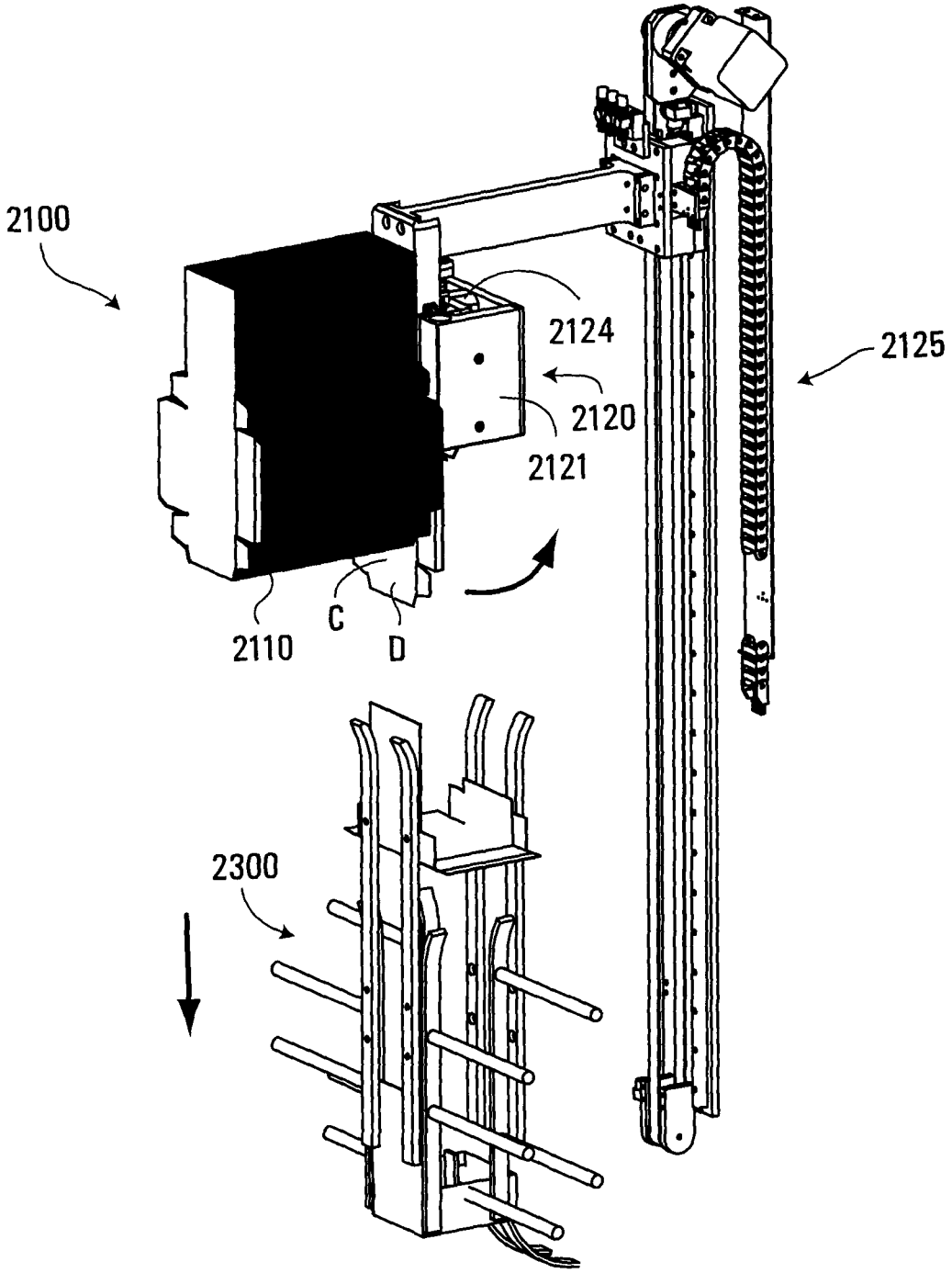
Figure 23:
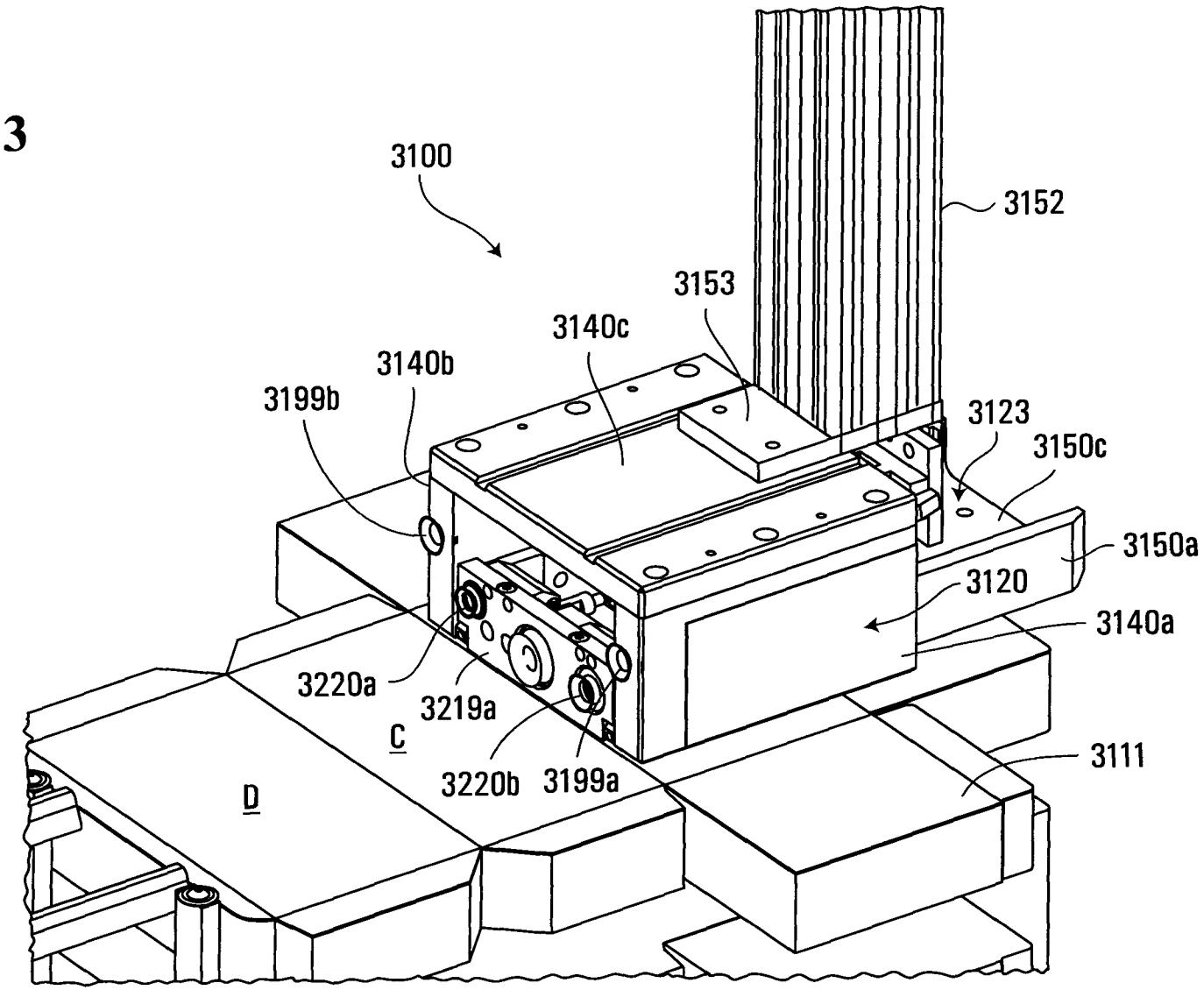
FIGS. 23 to 26 are perspective view of a third alternate system.

It will be appreciated that in some embodiments, the system could be also configured so that a magazine may discharge blanks to a mandrel apparatus from the side rather than the top or bottom whereby the general orientation of the movement of the blank and the mandrel apparatus through a rail and plough apparatus is generally vertically upwards or downwards. One example of such a configuration is illustrated in FIGS. 21 and 22. System 2100 is also constructed substantially the same way as system 100 with generally all the same components. However, the orientation of system 2100 rotated by about 90 degrees to generally vertically orientation compared to system 100. Therefore, each blank 2111 of system 2100 (each of which may be like blank 111) is moved generally longitudinally in a generally vertically downwards direction.

System 2100 therefore may have a magazine 2110 holding blanks 2111 that is positioned to hold blanks 2111 in a generally vertical orientation and horizontally spaced from mandrel apparatus 2120, panel rotating apparatus 2124 and mandrel movement and support apparatus 2125. Mandrel apparatus 2120 may thus be constructed like mandrel apparatus 120 with a mandrel 121, but may be oriented in a generally 90 degree rotated configuration compared to mandrel apparatus 120. Likewise panel rotating apparatus 2124 and mandrel movement and support apparatus 2125 may be constructed like panel rotating apparatus 124 and mandrel movement and support apparatus 125 respectively, but each is also oriented in a generally 90 degree rotated configuration. System 2100 may also include a panel folding and guide apparatus 2300 that may be a rail and plough constructed like apparatus 300, but again can be oriented in a generally 90 degree rotated position compared to apparatus 300.

In operation of system 2100, magazine 2110 may provide blanks in a stack such that there is a vertically oriented outward facing, surface of the "bottom" blank in the stack that is just in contact with, or is a very short distance spaced from, the outward facing surfaces of mandrel 2121. Next, magazine 2110 and panel rotating apparatus 2124 may co-operate so that the single blank 2111 from the "bottom" of the stack of blanks may be retrieved from the magazine 2110 and be transferred to the mandrel apparatus 2120.

As with the embodiment of FIGS. 1-18 described above, a PLC like PLC 132 may cause panel rotation apparatus 2124 to extend so that a rotating plate 2219 and suction cups thereon are rotated to be in an orientation that is generally vertical. Upon coming into close proximity or contact with a panel C, suction cups may engage the vertically oriented and outward facing surface of panel C of the bottom blank 2111 in the stack. The blank 2111 may also at the same time be supported proximate the vertical surface of the mandrel support frame by the magazine until the blank has been engaged by the panel rotation apparatus 2124.

Thereafter panel rotating apparatus 2124 may be operated by rotating plate 2219 so that panels C and D may be rotated—preferably approximately ninety (90) degrees to a generally horizontal position, but otherwise generally as describe above, to form a generally L-shaped configuration. Vacuum may also be applied to suction cups through operation of the PLC during the rotation of the panels C and D. The air suction force that may be developed at the outer surfaces of suction cups of panel rotation apparatus 2124 may be sufficient so that panels C and D of a blank can be rotated approximately 90 degrees.

Once panel C reaches the horizontal position, the suction cups associated with panel rotating apparatus plate 2124 hold panel C against the forward facing surfaces of mandrel 2121 with panel D also generally remaining in a horizontal orientation.

The rotation of panels C and D will also tend to pull that blank horizontally and perhaps a very small distance downward direction, the effect of which may be to free the top blank from magazine 2110. The result is that the bottom blank is now capable of being moved forward by the mandrel apparatus 2120 towards the panel folding and guide apparatus 2300. As in the other two systems 100 and 1100 described above, the magazine employed in system 2100 may be just a stack of carton blanks held in position by horizontal rails (not shown). The magazine may operate using a combination of the other two types of magazines described above (e.g. the orientations in FIGS. 1 and 19). Because gravity would not pull the carton blanks to the "bottom" of the stack, it could utilize a PLC controlled motor to push the whole stack sequentially towards the mandrel as carton blanks are taken from the bottom of the stack and formed. In addition, to prevent the carton blanks from tipping over and falling out of the magazine 2110, at the bottom of the stack, there could be small metal tabs attached to the rails (not shown in the drawings) that may protrude out into the plane of the stack such that the stack will rest on the tabs after being advanced by the PLC controlled motor. In general, the stack may be held up by the tabs against or closely proximate to the top of the mandrel. When the panel rotation apparatus 2124 engages the bottom carton blank and rotates the front panel towards the horizontal, the bottom carton blank may be pulled through the tabs and out of the magazine 2110. The tabs themselves may remain stationary, but because the carton blank is slightly flexible, the carton blank may bend from the force of the rotation device and pull out of the magazine. In this way, the system 2100 prevents more than one blank at a time from being taken. Of course other embodiments for a magazine set-up could be employed in system 2100.

Thereafter, the panel folding and guide apparatus 2300 will cause the blank to be folded in the same manner as described above in relation to rail and plough apparatus 300, but in an orientation that is vertically inverted.

In yet another embodiment as depicted in FIGS. 23 to 26, a system 3100 is illustrated in which the mandrel may be decoupled from the panel rotating apparatus and support frame. In such a configuration, the panel rotation apparatus and support frame may remain in a fixed position and not move with the mandrel and partially folded blank in a longitudinal direction towards the rail and plough apparatus.

System 3100 may for the most part be constructed substantially the same way as system 100 with generally most of the same components. System 3100 therefore may have a magazine 3110 holding blanks 3111 below a mandrel apparatus 3120, a panel rotating apparatus 3124 and a mandrel movement and support apparatus (not shown). Mandrel apparatus 3120 may be constructed in a similar manner to mandrel apparatus 120 with a mandrel 3121. Likewise panel rotating apparatus 3124 and mandrel movement and support apparatus may be constructed like panel rotating apparatus 124 and mandrel movement and support apparatus 125 respectively. However, panel rotating apparatus 3124 is decoupled from mandrel movement and support apparatus. System 3100 may also include a panel folding and guide apparatus 3300 that may be a rail and plough constructed like apparatus 300.

Mandrel 3121 may include a pair of spaced opposed elongated and longitudinally extending side plate members 3140*a* and 3140*b*. Side plates 3140*a*, 3140*b* may be interconnected by and joined to an upper horizontally oriented plate 3140*c*. Side plates 3140*a*, 3140*b* and upper plate 3140*c* may be integrally formed together. Mandrel side plates 3140*a* and 3140*b* may contain a groove or channel (not shown) on their inner surfaces for receiving mandrel support rails 3141*a*, 3141*b* respectively so that the during extraction of a blank 3111 from magazine 3110, mandrel 3121 can be supported by the support frame 3123 and may be generally restrained from vertical and transverse motion. However, it should be noted that during longitudinal movement of mandrel 3121 caused by movement and support apparatus (not shown), mandrel side plates 3140*a* and 3140*b* will slide longitudinally relative to rails 3141*a*, 3141*b* respectively. The result may be that after extraction of a blank 3111 from magazine 3110, and the initial folding of the blank 3111 on mandrel 3121, mandrel 3121 can move away with the extracted blank 3111 longitudinally from rotating apparatus 3124 and support frame 3123.

Mandrel 3121 may be interconnected to and supported by a vertical frame support member 3152 having a connection plate 3153 extending horizontally at the lower surface of vertical member 3152. Plate 3153 may have screw holes 3155 which may enable screws (not shown) to pass down into threaded holes (not shown) in an upper horizontal surface of mandrel plate 3140*c*. Vertical support member 3152 may be conveniently formed from a light but relatively strong material that can be readily formed into a tube, such as for example aluminium. Vertical support member 3152 may be formed as a hollow channel member that has a longitudinally extending cavity that allows for electrical and communication cables and pressurized/vacuum air hoses to pass through from an upper end to a lower end. In this way, electrical power/communication cable and air hoses can deliver power, electrical signals and air to the suction cups 3199*a*, 3199*b* that are positioned to face outwards in a generally horizontal orientation. Suction cups can be mounted in the end faces of side plates 3140*a*, 3140*b* respectively. The supply of vacuum to suction cups 3199*a*, 3199*b* may be controlled by a PLC like PLC 32.

Vertical member 3152 also has an upper end portion that is interconnected to the mandrel moving apparatus (not shown). Mandrel support and moving apparatus may be used to support and move in reciprocating forward and rearward longitudinal movement mandrel 3121.

Panel rotating apparatus 3124 may engage one blank 3111 and may be employed to rotate a blank 3111 panels C and D relative to one or more other panels. The movement of unit 3124 can be controlled by the PLC in such a manner that it can rotate so as to move a panel C (and panel D which is attached to an end of panel C) of a carton blank 3111 through a rotation of approximately 90 degrees, in an aligned manner, at an appropriate time.

Figure 24:
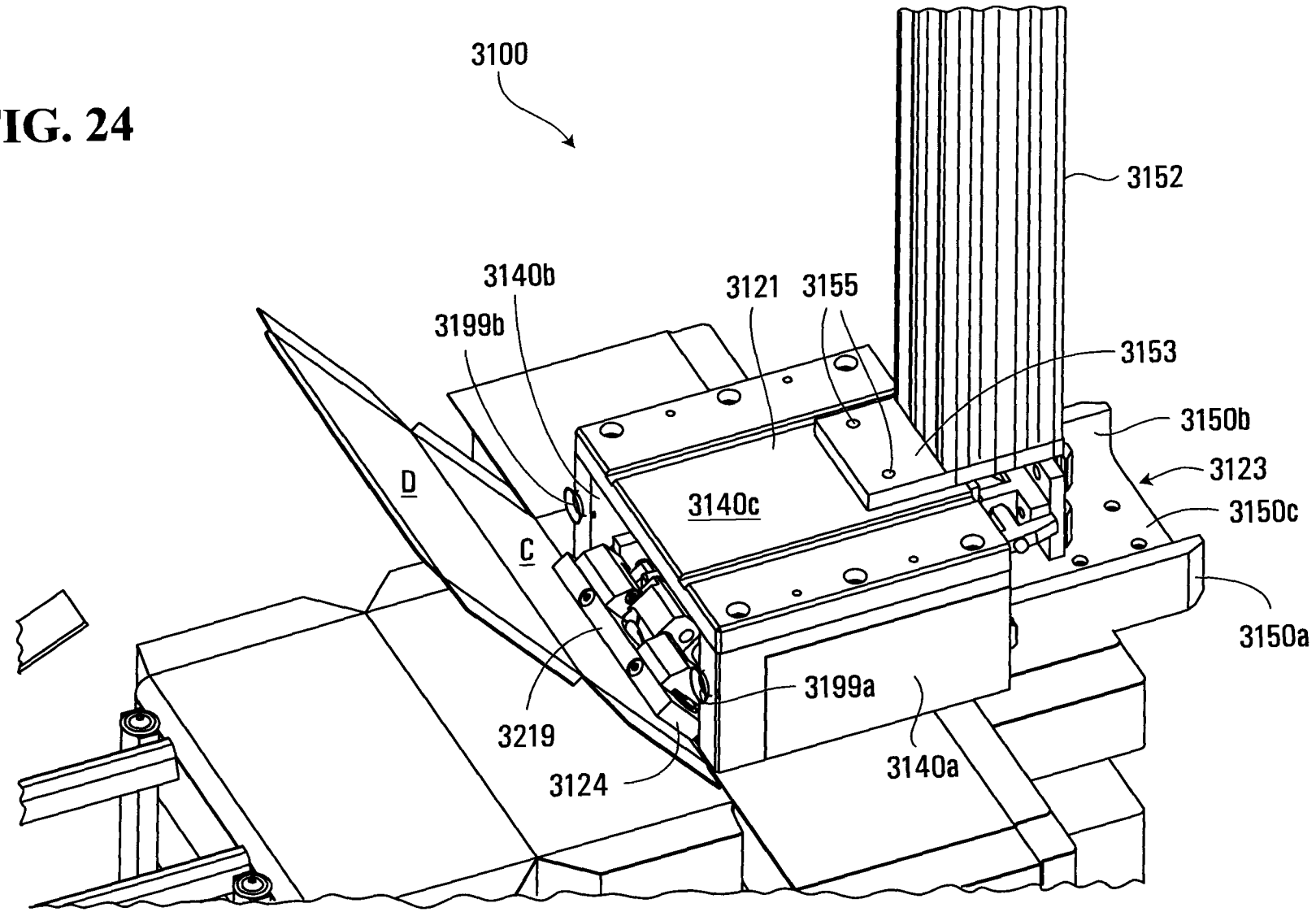
Figure 25:
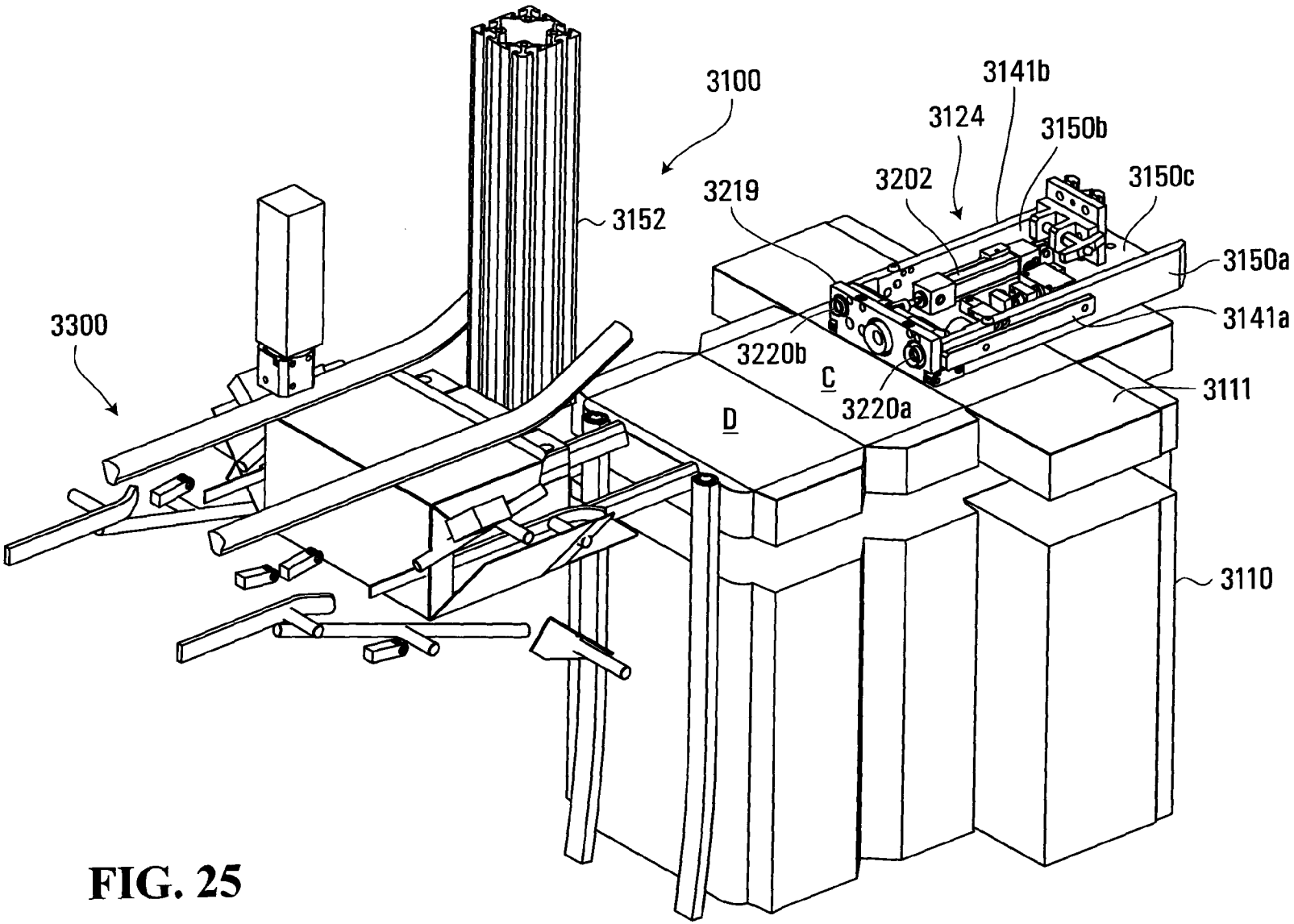
Figure 26:
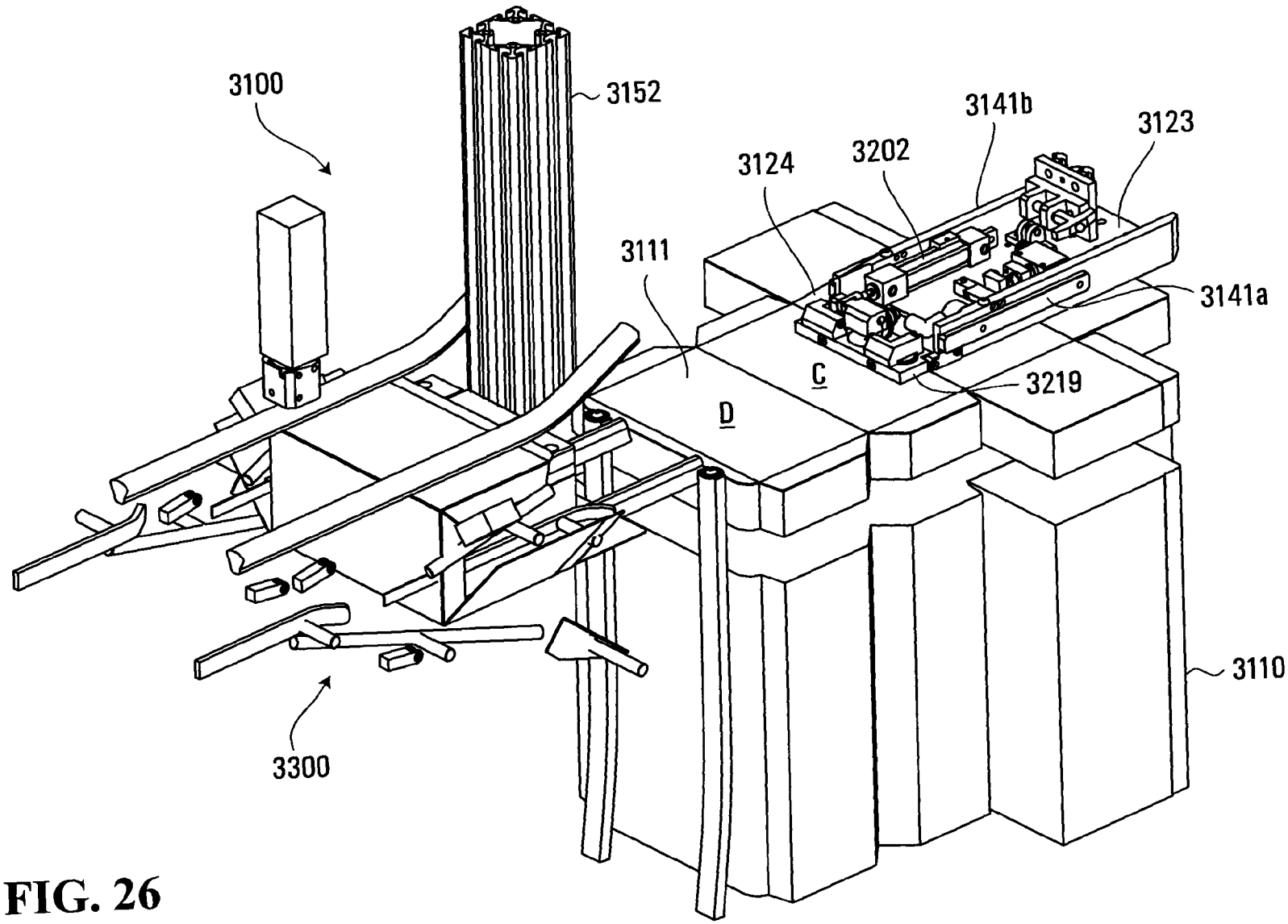

Unit 3124 will be described in overview and with particular reference to FIGS. 24 and 25. Like unit 124 in the previous system 100, unit 3124 may include a longitudinally oriented piston device 3202 which has piston blocks that rest on bottom plate 3150*c* of support frame 3123. Piston 3202 may be a conventional pneumatic reciprocating cylinder and is operable to move in a reciprocal movement between a fully extended position (not shown) and a retracted position. To channel the compressed air appropriately, valves (not shown) can be driven between open and closed positions by solenoids responsive to signals from PLC 132. The valves could be located proximate the piston 3202 or be disposed elsewhere. Electrical lines carrying signals from PLC could also pass through vertical member 3152 to operate the valves.

A piston rod of piston 3202 is provided with an extended arm portion that provides for a hinge connection for pivoting the panel rotating apparatus 3124 between a generally horizontal position and a generally vertical position.

Panel rotation apparatus 3124 also comprises panel rotating plate 3219 Panel rotating plate 3219 may be attached by way of piano hinge to forward lower extensions of side plates 3150*a*, 3150*b* of support frame 3123. As a result of the movement of piston the cylinder rod will extend or retract allowing the arm to pivot relative to rotating apparatus 3124. The movement of piston rod thus causes the panel rotating plate 3219 to rotate through a certain angular distance relative to mandrel 3121.

Air suction cups 3220*a* and 3220*b* may be interconnected through block units to a source of vacuum. A plurality of valves that may be operated by the PLC and may also include a vacuum generator apparatus such as apparatus 221 in the previous system 100. If a vacuum generator is utilized, pressurized air may be delivered from an external source through vertical support member 3152. The vacuum generator will then convert the pressurized air to a vacuum that can then be delivered to suction cups 3220*a*, 3220*b*.

In operation of system 3100, magazine 3110 may be raised so that the upper generally horizontally oriented surface of the upper-most blank 3111 is just in contact with, or is a very short distance spaced from (e.g. within ¼ inch) the bottom surfaces of frame 3123 and mandrel 3121. Next, magazine 3110 and panel rotating apparatus 3124 may co-operate so that the single blank 3111 from the top of the stack of carton blanks may be retrieved from the magazine 3110 and be transferred to the mandrel apparatus 3120. Thus, in this way the panel rotating apparatus 3124 may also serve as a transfer mechanism for transferring carton blanks in series from the magazine 3110 to the mandrel 3121.

Under the control of the PLC, panel rotation apparatus 3124 may extend reciprocating piston rod so that the rotating plate 3219 and the suction cups 3220*a*, 3220*b* thereon are rotated to be in an orientation that is downward facing. Upon coming into close proximity or contact with panel C, suction cups 3220*a*, 3220*b*, may engage the upward facing surface of panel C of the top blank 3111 in the stack. Panels A and B of the blank 3111 are at the same time are maintained generally in position up against or proximate the lower surface of support frame 3123 and mandrel side plates 3140*a*, 3140*b*. Panels A, B, C and D continue to be supported underneath by physical contact with the upper surface of another underlying blank 111 in the stack.

Panel rotating apparatus 3124 may be operated by the PLC to rotate rotating plate 3219 about hinge so that panels C and D may be rotated—preferably approximately ninety (90) degrees—about a pre-determined fold line between panel B and C. Thus panels C and D are rotated relative to panels A and B from a generally flat and horizontal orientation to a generally vertical and angled orientation, thus forming a generally L-shaped configuration.

Vacuum may also be applied to suction cups 3220*a*, 3220*b* through operation of PLC 132 during the rotation of the panels C and D. The air suction force that may be developed at the outer surfaces of suction cups 3220*a*, 3220*b* of panel rotation apparatus 3124 may be sufficient so that panels C and D of a blank 3111 can be rotated from the flat position shown in FIG. 23 to an angled configuration.

Once panel C reaches the vertical position, the suction cups 3220*a*, 3220*b* associated with panel rotating apparatus plate 3129 may hold panel C against the forward facing surfaces of mandrel side plates 3140*a*, 3140*b* and the outer surface of 3219*a* of panel rotating plate 3219 with panel D also generally remaining in a vertical orientation until suction cups 3199*a*, 3199*b* of mandrel 3121 are activated by PLC and can then engage panel C of blank 3111. Once suction cups 3199*a*, 3199*b* of mandrel 3121 are activated and engage panel C of blank 3111, cups 3220*a* and 3220*b* of rotation apparatus 3124 can be de-activated. The rotation of panels C and D will also tend to pull that blank upwards and perhaps a very small distance forward, the effect of which may be to free the top blank from the blank beneath it that is still on the stack. The result is that the blank 3111 now held by suction cups 3199*a* and 3199*b*, is now capable of being moved forward by the mandrel apparatus 3120 towards the panel folding and guide apparatus 3300.

Next, mandrel support and moving apparatus (not shown) may be used to move mandrel apparatus 3120 longitudinally forward towards panel folding and guide apparatus 3300, thus also moving blank 3111 that is held to mandrel 3121.

System 3100 may have the advantage of allowing for faster operation of the carton former relative to system 100 shown in FIG. 1. This is because as the mandrel apparatus 3120 is being moved longitudinally forward with a first blank to form a carton, the panel rotation apparatus 3124 can be rotated to engage the surface of a second blank from the magazine. Once the mandrel apparatus 3120 has moved the first blank through the panel folding and guide apparatus 3300 to form a carton and the mandrel apparatus 3120 is reversed to its original position, the panel rotation apparatus 3124 will rotate the front panels of the second blank in an L-shaped configuration around the mandrel 3121. The mandrel 3121 can now move forward longitudinally with the second blank to repeat the process.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

The invention claimed is:

1. A system for forming a carton from a generally flat carton blank, said system comprising:

(a) a mandrel having a first surface oriented generally at a first orientation and a second surface oriented at a second orientation that is at an angle to said first orientation, wherein said carton blank has a first portion that is operable to be positioned proximate said first surface of said mandrel;

(b) a first rotating apparatus operable to engage a second portion of said carton blank and while said mandrel is stationary, said first rotating apparatus operable to rotate so as to rotate said second portion of said blank from said first orientation while said first portion is maintained in a position proximate said first surface of said mandrel such that said second portion is oriented in said second orientation that is generally at said angle to said first portion of said carton blank and said second portion of said carton blank being positioned proximate said second surface of said mandrel.

2. A system as claimed in claim 1 wherein said angle is approximately 90 degrees.

3. A system as claimed in claim 2 further comprising a second rotating apparatus operable to rotate a third portion of said carton blank relative to said first and second portions to a third orientation.

4. A system as claimed in claim 3 wherein said third orientation is generally parallel to said first orientation.

5. A system as claimed in claim 4 wherein said second rotating apparatus is a portion folding and guide apparatus.

6. A system as claimed in claim 5 further comprising a movement apparatus, said movement apparatus operable for moving said mandrel towards said folding and guide apparatus while said first portion of said carton blank is positioned proximate said first surface of said mandrel and said second portion of said carton blank is positioned proximate said second surface of said mandrel, such that said third portion of said carton blank can be rotated relative to said first and second portions during movement of said mandrel by said movement apparatus by co-operation of said movement apparatus and said folding apparatus.

7. A system as claimed in claim 6 wherein said first rotating apparatus is coupled to said mandrel, such that said movement apparatus is operable for moving said mandrel and said first rotating apparatus towards said folding and guide apparatus.

8. A system as claimed in claim 6 wherein said first rotating apparatus is de-coupled from said mandrel, such that said movement apparatus is operable for moving said mandrel, and not moving said first rotating apparatus, towards said folding and guide apparatus.

9. A system as claimed in claim 2 wherein said first orientation is generally horizontal.

10. A system as claimed in claim 2 wherein said first orientation is generally vertical.

11. A system for forming a carton comprising:

(a) a magazine for storing a plurality of carton blanks in a generally flat configuration, each said carton blank comprising a first panel and a second panel;

(b) a mandrel having a first surface oriented at a first orientation and a second surface oriented at a second orientation that is generally orthogonal to said first orientation;

(c) a panel rotation apparatus operable to engage said second panel of said carton blank and while said mandrel is stationary, said rotation apparatus being operable to rotate so as to rotate said second panel to proximate to, and generally in the same orientation as, said second surface of said mandrel such that said second panel is oriented in a second orientation generally orthogonal to said first panel.

12. A system as claimed in claim 11 further comprising a movement apparatus and a folding apparatus, said movement apparatus for moving said mandrel, while said mandrel is engaged with said carton blank, towards said folding apparatus, so that a third panel of said carton blank can be rotated relative to said first and second panels during movement of said mandrel by said movement apparatus by co-operation of said movement of said mandrel by said movement apparatus and said folding apparatus.

13. A system a claimed in claim 12 wherein said mandrel is movable by said movement apparatus from a first position to a second position, such that during said movement of said mandrel from said first position to said second position, said folding apparatus folds at least said third panel to produce at least part of a carton form.

14. A system a claimed in claim 13 wherein said mandrel is movable from said second position to a third position wherein said mandrel has disengaged from said carton form.

15. A system as claimed in claim 12 wherein said first, second and third panels of said carton blank are arranged longitudinally in series, such that when said first, second and third panels have been oriented in said first, second and third positions, said first panel forms a base wall, said second panel forms an end wall and said third panel forms a forms a top wall of a carton.

16. A system as claimed in claim 12 further comprising a PLC to control the operation of said panel rotation apparatus and said movement apparatus.

17. A system as claimed in claim 12 further comprising a transfer mechanism for transferring a plurality of said carton blanks in series from said magazine to said mandrel.

18. A system as claimed in claim 13, wherein said carton blank further comprises fourth and fifth panels positioned on opposite sides of said first panel, and connected to said first panel, and wherein said folding apparatus is also operable during movement of said mandrel from said first position to said second position, to fold said fourth and fifth panels to fourth and fifth positions respectively, such that said fourth and first panels form opposed side walls of said carton.

19. A system as claimed in claim 17 further comprising a panel holding mechanism for holding said first panel of said carton blank of said plurality of carton blanks in said first orientation and in a position proximate said first surface of said mandrel while said panel rotation apparatus engages said second panel of said carton blank and rotates said second panel to proximate to, and generally in the same orientation as, said second surface of said mandrel such that said second panel is oriented in said second orientation generally orthogonal to said first panel.

20. A method for forming a carton from a carton blank comprising:

(a) Orienting said carton blank in a generally flat first orientation;

(b) rotating a first portion and a third portion of said blank from said first orientation to a second orientation that is generally orthogonal to a second portion of said carton blank, while said second portion is stationary;

(c) after (b), rotating said third portion of said carton blank relative to said first and second portions to a third orientation;

wherein said rotating of at least a third portion of said carton blank comprises moving the carton blank longitudinally while said first portion of said blank is at said second orientation and said second portion is at said first orientation, and so that said third portion of said carton blank is rotated relative to said first and second portions during said movement and by co-operation of said movement and engagement with a folding apparatus.

21. A method as claimed in claim 20 wherein said third orientation is generally parallel to said first orientation.

22. A method of forming a carton from a carton blank comprising:

(a) providing a carton blank in a first generally flat orientation, said carton blank having first and second and third portions, said first portion of blank being generally adjacent and parallel to a first portion of a mandrel;

(b) while said mandrel is stationary, rotating said second and third portions of said carton blank about said mandrel so said second and third portions remain generally aligned in the same plane and both are positioned at a second orientation that is generally orthogonal to said first portion.

23. A method as claimed in claim 22 further comprising moving said mandrel and said carton blank longitudinally while said first portion of said blank is at said first orientation and said second portion is at said second orientation, and so that a third portion of said carton blank is rotated relative to said first and second portions by co-operation of said movement and engagement with a folding apparatus.

24. A method for forming a carton from a carton blank comprising:

(a) orienting a carton blank having first, second and third portions all oriented in a first planar orientation;

(b) while said third portion is stationary, rotating said first and second portions of said blank together from said first orientation to a second orientation while maintaining said third portion in said first orientation, said first and second portions being located adjacent to each other;

(c) further rotating said third portion of said carton blank relative to said first and second portions to a third orientation.

25. A method as claimed in claim 24 wherein said third orientation is generally parallel to but spaced from said first orientation.

26. A method for forming a container from a container blank, said method comprising:

(a) orienting a foldable container blank having a plurality of portions all oriented in a first substantially planar orientation;

(b) rotating a first portion and a second portion of said plurality of portions, said first and second portions being joined together and located adjacent each other, together from said first orientation to a second orientation while maintaining a plurality of remaining portions of said blank stationary and in said first orientation;

(c) orienting the second portion and the remaining portions of said blank relative to said first portion to form a container adapted for receiving an item.

27. A system for forming a container from a generally flat foldable blank having a plurality of panels which are all oriented in a first substantially planar orientation, said system comprising:

(a) a mandrel having a first surface oriented generally at a first orientation and a second surface oriented at a second orientation that is at an angle to said first orientation, wherein said blank has a first panel that is operable to be positioned and held proximate said first surface of said mandrel;

(b) a first rotating apparatus operable to engage a second panel and a third panel, said second and third panels being joined together and located adjacent each other, said first rotating apparatus operable to rotate said second and third panels together from said first orientation to a second orientation while a remaining plurality of panels remain in the first orientation and said first panel is maintained in a position proximate said first surface of said mandrel such that said second and third panels are both oriented in said second orientation that is generally at an angle to said first panel and said second panel being positioned proximate said second surface of said mandrel.

28. A system as claimed in claim 27 operable to rotate said third panel of said blank relative to said first and second panels to a third orientation.

29. A system as claimed in claim 28 wherein said third orientation is generally parallel to said first orientation.

30. A system as claimed in claim 28 wherein said system is operable to rotate said third panel of said carton blank by moving said carton blank longitudinally while said first panel of said blank is at said second orientation and said second panel is at said first orientation, and so that said third panel of said carton blank is rotated relative to said first and second panel by co-operation of said movement and engagement with a folding apparatus.

31. A system for forming a carton from a generally flat carton blank, said system comprising:

(a) a mandrel having a first surface oriented generally at a first orientation and a second surface oriented at a second orientation that is at an angle to said first orientation, wherein said carton blank has a first portion that is operable to be positioned proximate said first surface of said mandrel;

(b) a first rotating apparatus operable to engage a second portion of said carton blank and while said mandrel is stationary, rotate said second portion of said blank from said first orientation while said first portion is maintained in a position proximate said first surface of said mandrel such that said second portion is oriented in said second orientation that is generally at said angle to said first portion of said carton blank and said second portion of said carton blank being positioned proximate said second surface of said mandrel;

(c) a movement apparatus, said movement apparatus operable for moving said mandrel towards a folding and guide apparatus while said first portion of said carton blank is positioned proximate said first surface of said mandrel and said second portion of said carton blank is positioned proximate said second surface of said mandrel, such said third portion of said carton blank can be rotated relative to said first and second portions during movement of said mandrel by said movement apparatus by co-operation of said movement apparatus and said folding and guide apparatus.

* * * * *